US010984932B2

(12) United States Patent
Urata et al.

(10) Patent No.: US 10,984,932 B2
(45) Date of Patent: Apr. 20, 2021

(54) AMORPHOUS SOFT MAGNETIC ALLOY AND INDUCTANCE COMPONENT USING THE SAME

(71) Applicants: TOKIN CORPORATION, Sendai (JP); TOHOKU UNIVERSITY, Sendai (JP)

(72) Inventors: Akiri Urata, Sendai (JP); Teruhiko Fujiwara, Sendai (JP); Hiroyuki Matsumoto, Sendai (JP); Yasunobu Yamada, Sendai (JP); Akihisa Inoue, Sendai (JP)

(73) Assignees: TOKIN CORPORATION, Miyagi (JP); TOHOKU UNIVERSITY, Miyagi (JP)

( * ) Notice: Subject to any disclaimer, the term of this patent is extended or adjusted under 35 U.S.C. 154(b) by 260 days.

(21) Appl. No.: 15/626,810

(22) Filed: Jun. 19, 2017

(65) Prior Publication Data

US 2017/0294254 A1 Oct. 12, 2017

Related U.S. Application Data

(62) Division of application No. 11/701,342, filed on Feb. 1, 2007, now abandoned.

(30) Foreign Application Priority Data

Feb. 2, 2006 (JP) ..... JP2006-026210
Dec. 1, 2006 (JP) ..... JP2006-326179

(51) Int. Cl.
*H01F 3/14* (2006.01)
*H01F 1/153* (2006.01)
(Continued)

(52) U.S. Cl.
CPC ..... *H01F 1/153* (2013.01); *B22F 9/002* (2013.01); *C22C 33/003* (2013.01);
(Continued)

(58) Field of Classification Search
CPC ..... B22F 9/002; C22C 28/00; C22C 33/003; C22C 33/0207; C22C 33/0257;
(Continued)

(56) References Cited

U.S. PATENT DOCUMENTS 3,856,513 A 12/1974 Chen et al.
3,986,867 A 10/1976 Masumoto et al.
(Continued)

FOREIGN PATENT DOCUMENTS

CN 1487536 A 4/2004
CN 1700369 A 11/2005
(Continued)

OTHER PUBLICATIONS

Shen et al, Bulk Glassy Fe—Ga—P—C—8—Si Alloys with High Glass-Forming Ability, High Saturation Magnetization and Good Soft Magnetic Properties: Materials Transactions: vol. 43, No. 5 (2002): pp. 1235-1239.
(Continued)

*Primary Examiner* — Jie Yang
(74) *Attorney, Agent, or Firm* — Holtz, Holtz & Volek PC

(57) ABSTRACT

An amorphous soft magnetic alloy of the formula $(Fe_{1-\alpha}TM_{\alpha})_{100-w-x-y-z}P_wB_xL_ySi_z\,Ti_pC_qMn_rCu_s$, wherein TM is Co or Ni; L is Al, Cr, Zr, Mo or Nb; $0\leq\alpha\leq0.3$, $2\leq w\leq18$ at %, $2\leq x\leq18$ at %, $15\leq w+x\leq23$ at %, $1<y\leq5$ at %, $0\leq z\leq4$ at %; p, q, r, and s represents an addition ratio such that the total mass of Fe, TM, P, B, L and Si is 100, and $0\leq p\leq0.3$, $0\leq q\leq0.5$, $0\leq r\leq2$, $0\leq s\leq1$ and $r+s>0$; the composition fulfills one of the following conditions: L is Cr, Zr, Mo or Nb; or L is a combination of Al and Cr, Zr, Mo or Nb, wherein $0<Al\leq5$ at
(Continued)

%, 1≤Cr≤4 at %, 0<Zr≤5 at %, 2≤Mo≤5 at %, and 2≤Nb≤5 at %; the alloy has a crystallization start temperature (Tx) which is 550° C. or less, a glass transition temperature (Tg) which is 520° C. or less, and a supercooled liquid region represented by ΔTx=Tx−Tg, which is 20° C. or more.

45 Claims, 3 Drawing Sheets

(51) Int. Cl.

| | |
|---|---|
| ***C22C 33/02*** | (2006.01) |
| ***H01F 41/02*** | (2006.01) |
| ***B22F 9/00*** | (2006.01) |
| ***C22C 45/02*** | (2006.01) |
| ***C22C 33/00*** | (2006.01) |
| *H01F 17/04* | (2006.01) |
| *H01F 17/06* | (2006.01) |
| *B22F 3/24* | (2006.01) |
| *C22C 28/00* | (2006.01) |

(52) U.S. Cl.
CPC ..... *C22C 33/0207* (2013.01); *C22C 33/0257* (2013.01); *C22C 45/02* (2013.01); *H01F 1/15308* (2013.01); *H01F 41/0226* (2013.01); *H01F 41/0246* (2013.01); *B22F 2003/248* (2013.01); *B22F 2998/00* (2013.01); *B22F 2998/10* (2013.01); *C22C 28/00* (2013.01); *H01F 1/15375* (2013.01); *H01F 3/14* (2013.01); *H01F 17/062* (2013.01); *H01F 2017/048* (2013.01)

(58) Field of Classification Search
CPC ..... C22C 45/02; H01F 17/062; H01F 1/153; H01F 1/15308; H01F 2017/048; H01F 41/0226; H01F 41/0246
USPC ..... 148/304
See application file for complete search history.

(56) References Cited

U.S. PATENT DOCUMENTS

| | | | | |
|---|---|---|---|---|
| 4,052,201 | A | | 10/1977 | Polk et al. |
| 4,187,128 | A | | 2/1980 | Billings et al. |
| 4,439,236 | A | | 3/1984 | Ray et al. |
| 4,473,401 | A | | 9/1984 | Masumoto et al. |
| 4,985,089 | A | * | 1/1991 | Yoshizawa ..... H01F 1/1535 148/303 |
| 5,338,376 | A | | 8/1994 | Liu et al. |
| 5,961,745 | A | | 10/1999 | Inoue et al. |
| 5,976,274 | A | | 11/1999 | Inoue et al. |
| 6,350,323 | B1 | | 2/2002 | Inoue et al. |
| 6,425,960 | B1 | | 7/2002 | Meguro et al. |
| 7,132,019 | B2 | | 11/2006 | Koshiba et al. |
| 7,170,378 | B2 | | 1/2007 | Fujiwara et al. |
| 7,172,660 | B2 | | 2/2007 | Song et al. |
| 2001/0001398 | A1 | | 5/2001 | Hasegawa et al. |
| 2002/0195178 | A1 | | 12/2002 | Liebermann et al. |
| 2003/0106619 | A1 | | 6/2003 | Decristofaro et al. |
| 2005/0161122 | A1 | | 7/2005 | Inoue et al. |
| 2005/0236071 | A1 | | 10/2005 | Koshiba et al. |
| 2005/0254989 | A1 | | 11/2005 | Fujiwara et al. |
| 2006/0170524 | A1 | | 8/2006 | Fujiwara |
| 2007/0258842 | A1 | | 11/2007 | Lu et al. |
| 2010/0188186 | A1 | | 7/2010 | Urata et al. |

FOREIGN PATENT DOCUMENTS

| | | | |
|---|---|---|---|
| CN | 1774773 | A | 5/2006 |
| CN | 1787125 | A | 6/2006 |
| CN | 101034609 | A | 9/2007 |
| DE | 2553003 | A1 | 8/1976 |
| DE | 19802349 | A1 | 7/1998 |
| EP | 0695812 | A1 | 2/1996 |
| JP | 4052201 | A | 10/1977 |
| JP | 5890708 | A | 5/1983 |
| JP | 9320827 | A | 12/1997 |
| JP | 11071647 | A | 3/1999 |
| JP | 11131199 | A | 5/1999 |
| JP | 2000144349 | A | 5/2000 |
| JP | 2000204452 | A | 7/2000 |
| JP | 2001152301 | A | 6/2001 |
| JP | 2001316782 | A | 11/2001 |
| JP | 2002030398 | A | 1/2002 |
| JP | 2002105607 | A | 4/2002 |
| JP | 2003253408 | A | 9/2003 |
| JP | 2007231415 | A | 9/2007 |
| KR | 19927003866 | A | 12/1992 |
| KR | 100278372 | B1 | 10/2000 |
| KR | 20050015563 | A | 2/2005 |
| WO | 02077300 | A1 | 10/2002 |

OTHER PUBLICATIONS

Shen et al, Superhigh strength and good soft-magnetic properties of (Fe, Co)—B—Si—Nb bulk glass alloys with high-glass forming ability: Applied Physics Letters: vol. 85, No. 21: Nov. 22, 2004: pp. 4911-4913.

Inoue et al, Fe- and Co-based bulk glass alloys with ultrahigh strength of over 4000 Mpa: Intermetallics 14 (2006) 936-944.

Inoue et al, Ultra-high strength above 5000 Mpa and soft magnetic properties of Co—Fe—Ta—B bulk glass alloys: Acta Materialia 52(2004): 1631-1637.

Inoue et al, Rapid Publication, "Fe-Based Ferromagnetic Glassy Alloy with Wide Supercooled Liquid Region", Institute for Materials Research, Tohoku University, Sendai 980-77, Japan, Materials Transactions, JIM, vol. 36, No. 9 (1995), pp. 1180-1183.

Shen et al, Formation, ductile deformation behavior and soft magnetic properties of (Fe, Co, Ni)—B—Si—Nb bulk glass alloys: Intermetallics 15 (2007) 9-16.

Chinese Office Action (and English translation thereof) dated Dec. 2, 2015, issued in counterpart Chinese Application No. 201410049912.8.

Chinese Office Action dated Dec. 31, 2010 which issued in counterpart Chinese Application No. 2009101276300 (and an English-language translation thereof).

Chinese Office Action dated Dec. 31, 2010 which issued in counterpart Chinese Application No. 2009101276395 (and an English-language translation thereof).

Chinese Office Action dated Nov. 7, 2008 which issued in counterpart Chinese Application No. 200710006386.7 (and an English-language translation thereof).

German Office Action dated Mar. 13, 2008 issued in counterpart German Application No. 10 2007 004 835.3-24 (and an English translation thereof).

Inoue et al, Soft Magnetic Bulk Glassy Fe—B—Si—Nb Alloys with High Saturation Magnetization above 1.5 T, Institute for Materials Research, Tohoku University, Sendai 960-8577, Japan, Materials Transactions, vol. 43, No. 4 (2002), pp. 766-769, 2002.

Inoue et al, Rapid Publication, "New Fe—Co—Ni—Zr—B Amorphous Alloys with Wide Supercooled Liquid Regions and Good Soft Magnetic Properties", Institute for Materials Research, Tohoku University, Sendai, Japan, Materials Transactions, JIM, vol. 38, No. 4 (1997), pp. 359-362.

Japanese Office Action dated Jan. 7, 2011 which issued in counterpart Japanese Application No. 2006-326179 (and a partial English-language translation thereof).

Korean Office Action dated Aug. 31, 2010 which issued in counterpart Korean Appl. No. 10-2008-0053183 (and English-languange translation thereof).

Korean Office Action dated Jul. 17, 2008 issued in counterpart Korean Appln. No. 10-2007-0010499.

* cited by examiner

AMORPHOUS SOFT MAGNETIC ALLOY AND INDUCTANCE COMPONENT USING THE SAME

CROSS-REFERENCE TO RELATED APPLICATIONS

This is a Divisional application of U.S. Ser. No. 11/220,417, filed Feb. 1, 2007, which is based upon and claims the benefit of priority from prior Japanese Patent Application No. 2006-26210, filed Feb. 2, 2006 and JP 2006-326179, filed Dec. 1, 2006, the entire contents of all of which are incorporated herein by reference.

BACKGROUND OF THE INVENTION

This invention relates to an amorphous soft magnetic alloy and further relates to a strip or ribbon, a powder, a member, and a component using such an alloy.

Magnetic amorphous alloys have started from Fe—P—C and then there have been developed Fe—Si—B of a low-loss material, Fe—B—C of a high saturation magnetic flux density (Bs) material, and so on. These materials have been expected as transformer materials because of their low losses, but have not yet been spread because of their higher costs and lower Bs as compared with conventional materials such as silicon steel sheets. Further, since these amorphous alloys require a cooling rates of $10^5$ K/sec or higher, it is only possible to produce ribbons thereof each having a thickness of only about 200 μm at maximum at the laboratory level. Therefore, it is necessary that the ribbon is wound into a magnetic core or the ribbons are laminated into a magnetic core, and this extremely limits the application of the amorphous alloys.

Since the latter half of 1980s, alloy systems called metal glasses have started to be developed in which, as opposed to amorphous alloys up to then, the glass transition is observed on the low temperature side of a crystallization temperature and a supercooled liquid region appears. The supercooled liquid region is considered to be related to the stability of a glass structure. Accordingly, such an alloy system is excellent in amorphous-forming ability, which was not present before then. For example, there have been discovered Ln-Al-TM, Zr—Al—Ni, and Pd—Cu—Ni—P based alloys have been discovered from which it is possible to produce metal glass bulk members each having a thickness of about several millimeters. Fe-based metal glasses have also been discovered since the middle of 1990s and there have been reported compositions that enable metal glass bulk members each having a thickness of 1 mm or more. For example, Fe—(Al, Ga)—(P, C, B, Si) (Non-Patent Document 1: Mater. Trans., JIM, 36 (1995), 1180), Fe—(Co, Ni)—(Zr, Hf, Nb)—B (Non-Patent Document 2: Mater. Trans., JIM, 38 (1997), 359; Patent Document 1: Japanese Unexamined Patent Application Publication (JP-A) No. 2000-204452), Fe—(Cr, Mo)—Ga—P—C—B (Patent Document 2: Japanese Unexamined Patent Application Publication (JP-A) No. 2001-316782), Fe—Co-RE-B (Patent Document 3: Japanese Unexamined Patent Application Publication (JP-A) No. 2002-105607), and so on are disclosed. However, while these alloys each improve the amorphous-forming ability as compared with the conventional alloys, a problem exists that the saturation magnetic flux density is low because of containing a large amount of nonmagnetic elements, and so on. It is difficult to satisfy both the amorphous-forming ability and the magnetic properties.

The conventionally known amorphous alloys, such as Fe—Si—B and Fe—P—C, are known as high-permeability and low-loss materials and thus are suitable for transformer cores, magnetic heads, and so on. However, since the amorphous-forming ability is poor, ribbons each having a thickness of about 20 μm and wire rods each having a thickness of about 100 μm have only been commercialized and further they should be formed into laminated or wound magnetic cores. Thus, the degree of freedom in shape is extremely small. On the other hand, it is possible to achieve three-dimensional formation by forming a low-loss amorphous powder with excellent soft magnetic properties into a dust core, which is thus considered to be promising. However, since the amorphous-forming ability is insufficient according to any of such compositions, it is difficult to produce a powder thereof by water atomization or the like. Further, if use is made of a low-priced ferroalloy material or the like containing impurities, it is expected that the amorphous-forming ability is lowered so as to cause a reduction in amorphous uniformity, thus leading to a reduction in soft magnetic properties. Also in the case of the Fe-based metal glasses, although the amorphous-forming ability is excellent in each of them, since it contains a large amount of metalloid elements while the content of iron family elements is low, it is difficult to simultaneously satisfy the magnetic properties thereof. Further, since the glass transition temperature is high, there also arises a problem of an increase in heat treatment temperature and so on.

SUMMARY OF THE INVENTION

It is therefore an object of this invention to provide an amorphous soft magnetic alloy having a supercooled liquid region and excellent in amorphous-forming ability and soft magnetic properties, by selecting and optimizing an alloy composition.

It is another object of this invention to provide a ribbon, a powder, a high-frequency magnetic core, and a bulk member each using such an amorphous soft magnetic alloy.

As a result of diligently studying various alloy compositions for the purpose of accomplishing the foregoing objects, the present inventors have found that the amorphous-forming ability is improved and a clear supercooled liquid region appears by adding one or more kinds of elements selected from Al, V, Cr, Y, Zr, Mo, Nb, Ta, and W to an Fe—P—B based alloy and specifying those composition components, and have completed this invention.

Further, the present inventors have found that the amorphous-forming ability is improved and a clear supercooled liquid region appears by adding one or more kinds of elements selected from Al, Cr, Mo, and Nb and further adding elements of Ti, C, Mn, and Cu to an Fe—P—B based alloy and specifying those composition components, which provides a further improved alloy composition, and have completed this invention.

According to one aspect of the present invention, there is provided an amorphous soft magnetic alloy which has a composition expressed by a formula of $(Fe_{1-\alpha}TM_{\alpha})_{100-w-x-y-z}P_wB_xL_ySi_z$, wherein unavoidable impurities are contained, TM is at least one selected from Co and Ni, L is at least one selected from the group consisting of Al, V, Cr, Y, Zr, Mo, Nb, Ta, and W, $0 \le \alpha \le 0.98$, $2 \le w \le 16$ at %, $2 \le x \le 16$ at %, $0 < y \le 10$ at %, and $0 \le z \le 8$ at %.

According to another aspect of the present invention, there is provided an amorphous soft magnetic alloy having a composition expressed by a formula of $(Fe_{1-\alpha}TM_{\alpha})_{100-w-x-y-z}P_wB_xL_ySi_zTi_pC_qMn_rCu_s$, wherein unavoidable impurities are contained, TM is at least one selected from Co and Ni, L is at least one selected from the group consisting of Al, Cr, Zr, Mo, and Nb, $0 \leq \alpha \leq 0.3$, $2 \leq w \leq 18$ at %, $2 \leq x \leq 5$ at %, $0 < y \leq 10$ at %, $0 \leq z \leq 4$ at %, and p, q, r, and s each represents an addition ratio given that the total mass of Fe, TM, P, B, L, and Si is 100, and are defined as $0 \leq p \leq 0.3$, $0 \leq q \leq 0.5$, $0 \leq r \leq 2$, and $0 \leq s \leq 1$.

According to still another aspect of the present invention, there is provided an amorphous soft magnetic alloy member made of the amorphous soft magnetic alloy above described. The amorphopus soft magnetic alloy member has a thickness of 0.5 mm or more and a cross-sectional area of 0.15 $mm^2$ or more.

According to yet another aspect of the present invention, there is provided an amorphous soft magnetic alloy ribbon made of the amorphous soft magnetic alloy above described. The amorphous soft magnetic alloy ribbon has a thickness of 1 to 200 μm.

According to a further aspect of the present invention, there is provided an amorphous soft magnetic alloy powder made of the amorphous soft magnetic alloy above described. The amorphous soft magnetic alloy powder has a particle size of 200 μm or less (excluding zero).

According to a still further aspect of the present invention, there is provided a magnetic core formed by machining the amorphous soft magnetic alloy member.

According to a yet further aspect of the present invention, there is provided a magnetic core formed by annularly winding the amorphous soft magnetic alloy ribbon above described.

According to another aspect of the present invention, there is provided a magnetic core above described which is formed by annularly winding said amorphous soft magnetic alloy ribbon through an insulator.

According to still another aspect of the present invention, there is provided a magnetic core formed by laminating substantially same-shaped pieces of the amorphous soft magnetic alloy ribbon above described.

According to yet another aspect of the present invention, there is provided a magnetic core formed by molding a mixture of a material powder comprising the amorphous soft magnetic alloy powder above-described and a binder added thereto in an amount of 10% or less by mass.

According to a further aspect of the present invention, there is provided an inductance component formed by applying a coil with at least one turn to the magnetic core above descrined.

According to a still further aspect of the present invention, there is provided an inductance component formed by integrally molding the magnetic core above-described and a coil. In the inductance component, the coil is formed by winding a linear conductor by at least one turn and is disposed in said magnetic core.

According to yet further aspect of the present invention, there is provided an inductance component formed by applying a coil with at least one turn to a magnetic core formed by molding a mixture of a material powder comprised of the amorphous soft magnetic alloy powder above-described and a binder added thereto in an amount of 5% or less by mass, a space factor of said material powder in said magnetic core being 50% or more. In the inductance component, a peak value of Q(1/tan δ) of said inductance component in a frequency band of 10 kHz or more is 20 or more, a peak value of Q(1/tan δ) of said inductance component in a frequency band of 100 kHz or more is 25 or more, a peak value of Q(1/tan δ) of said inductance component in a frequency band of 500 kHz or more is 40 or more, or a peak value of Q (1/tan δ) of said inductance component in a frequency band of 1 MHz or more is 50 or more.

By selecting an Fe amorphous alloy composition of this invention, it is possible to obtain an alloy having a supercooled liquid region and excellent in amorphous-forming ability and soft magnetic properties.

Further, according to this invention, it is possible to provide a ribbon, a powder, a high-frequency magnetic core, and a bulk member each using such an amorphous soft magnetic alloy which is excellent in amorphous-forming ability and soft magnetic properties.

DESCRIPTION OF THE PREFERRED EMBODIMENT

Figure 1:
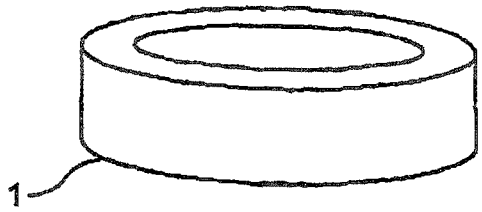
FIG. 1 is an external perspective view showing one example according to a basic structure of a high-frequency magnetic core of this invention.

This invention will be described in further detail.

At first, a first basic composition of an amorphous soft magnetic alloy of this invention will be described.

The present inventors, as a result of various studies, have found that an economical amorphous soft magnetic alloy powder excellent in magnetic properties and amorphous-forming ability is obtained by selection so as to define an alloy composition having a composition formula of $(Fe_{1-\alpha}TM_{\alpha})_{100-w-x-y-z}P_wB_xL_ySi_z$, wherein unavoidable impurity elements are contained, $0 \leq \alpha \leq 0.98$, $2 \leq w \leq 16$ at %, $2 \leq x \leq 16$ at %, $0 < y \leq 10$ at %, $0 \leq z \leq 8$ at %, Fe, P, B, and Si represents iron, phosphorous, boron, and silicon, respectively, TM is at least one selected from Co (cobalt) and Ni (nickel), and L is at least one selected from the group consisting of Al (Alminum), V (vanizium), Cr (cromium), Y (yttrium), Zr (zirconium), Mo (Molybdenum), Nb (niob), Ta (tantal), and W (tungsten), and that high magnetic properties and excellent amorphous-forming ability can be obtained and the bulk member, ember, thin ribbon, and powder made of an amorphous alloy having the composition can be obtained by working the alloy appropriately.

For example, an amorphous self magnetic alloy having the composition which has an excellent performance to exhibit an excellent amorphous forming ability, magnetic core can be obtained which has sizes of a thickness of 0.5 mm or more and a cross sectional area of 5 mm2 or less, which sizes were not conventionally present and a high permeability over a wide frequency band or a broad-band and a high saturation magnetic flux density.

For example, in the case of the amorphous magnetic ribbon having the composition, the magnetic core having a similar magnetic property can be obtained by winding the ribbon and the magnetic core are formed by laminating or stacking the ribbons through insulators to improve them further in properties.

For example, in the case of the amorphous magnetic powder having the composition a dust core having a similar excellent property can be obtained by mixing the powder with a binder appropriately and molding using a molding die and by applying oxidation treatment or insulating coating to a surface of powder.

That is, this invention makes it possible to obtain an economical amorphous soft magnetic alloy powder excellent in magnetic properties, amorphous-forming ability, and powder filling properties by selection so as to define an alloy composition having a composition formula of $(Fe_{1-\alpha}TM_{\alpha})_{100-w-x-y-z}P_wB_xL_ySi_z$, wherein unavoidable impurity elements are contained, $0\leq\alpha\leq0.98$, $2\leq w\leq16$ at %, $2\leq x\leq16$ at %, $0<y\leq10$ at %, $0\leq z\leq8$ at %, TM is at least one selected from Co and Ni, and L is at least one selected from the group consisting of Al, V, Cr, Y, Zr, Mo, Nb, Ta, and W, and, further, since a dust core is produced using a molding die or the like to form the obtained powder applied with oxidation treatment or insulating coating into a molded product according to a proper forming method, there is obtained the high-permeability dust core adapted to exhibit excellent permeability properties over a broad-band, which was not conventionally present and, as a result, the high-frequency magnetic core made of the soft magnetic material with a high saturation magnetic flux density and a high resistivity can be produced at a low cost. Further, by winding a coil with one or more turns around this high-frequency magnetic core, it is possible to produce a low-priced and high-performance inductance component that was not conventionally present, which thus is quite beneficial in industry.

Herein, according to a first example of the first basic composition of this invention, there is provided an amorphous magnetic alloy having a composition expressed by a formula of $Fe_{100-w-x-y}P_wB_xL_y$ (where Fe is a main component, unavoidable impurities may be contained, L is at least one of elements selected from the group consisting of Al, V, Cr, Y, Zr, Mo, Nb, Ta, and W, 2 at $\%\leq w\leq16$ at %, 2 at $\%\leq x\leq16$ at %, and 0 at $\%<y\leq10$ at %), which is excellent in glass forming ability and soft magnetic properties and has a supercooled liquid region.

According to a second example of this invention, there is provided an amorphous magnetic alloy having a composition expressed by a formula of $Fe_{100-w-x-y}P_wB_xL_ySi_z$, wherein Fe is a main component, unavoidable impurities may be contained, L is at least one of elements selected from the group consisting of Al, V, Cr, Y, Zr, Mo, Nb, Ta, and W, 2 at $\%\leq w\leq16$ at %, 2 at $\%\leq x\leq16$ at %, 0 at $\%<y\leq10$ at %, and 0 at $\%<z\leq8$ at %, which is excellent in glass forming ability and soft magnetic properties and has a supercooled liquid region.

According to a third example of this invention, there is provided an amorphous magnetic alloy having a composition expressed by a formula of $(Fe_{1-\alpha}TM_{\alpha})_{100-w-x-y}P_wB_xL_y$, wherein Fe is a main component, unavoidable impurities may be contained, TM is at least one of elements selected from Co and Ni, L is at least one of elements selected from the group consisting of Al, V, Cr, Y, Zr, Mo, Nb, Ta, and W, $0<\alpha\leq0.98$, 2 at $\%\leq w\leq16$ at %, 2 at $\%\leq x\leq16$ at %, and 0 at $\%<y\leq10$ at %, which is excellent in glass forming ability and soft magnetic properties and has a supercooled liquid region.

According to a fourth example of this invention, there is provided an amorphous magnetic alloy having a composition expressed by a formula of $(Fe_{1-\alpha}TM_{\alpha})_{100-w-x-y}P_wB_xL_ySi_z$, wherein Fe is a main component, unavoidable impurities may be contained, TM is at least one of elements selected from Co and Ni, L is at least one of elements selected from the group consisting of Al, Mo, Nb, Ta, W, V, and Cr, $0<\alpha\leq0.98$, 2 at $\%\leq w\leq16$ at %, 2 at $\%\leq x\leq16$ at %, 0 at $\%<y\leq10$ at %, and 0 at $\%<z\leq8$ at %), which is excellent in glass forming ability and soft magnetic properties and has a supercooled liquid region.

As described above, in this invention, the soft magnetic properties and the amorphous-forming ability are improved by limiting the composition and having the supercooled liquid region. In this invention, when the supercooled liquid region exceeds 20° C., better soft magnetic properties and amorphous-forming ability are exhibited. Further, the viscosity is rapidly reduced in the supercooled liquid region, thereby enabling machining utilizing viscous flow deformation.

According to this invention, in any of the foregoing examples, there is provided an amorphous soft magnetic member having a glass transition start temperature of 520° C. or less when raised in temperature.

In this invention, the main component elements are Fe, P, and B and the glass transition temperature is 450 to 500° C. This is a value which is lower by about 100° C. as compared with a conventional composition of $(Fe_{0.75}Si_{0.10}B_{0.15})_{96}Nb_4$ having a supercooled liquid region, which is disclosed in Non-Patent Document 3 (Mat. Trans. 43 (2002) pp. 766-769). Accordingly, heat treatment is facilitated because of a decrease in heat treatment temperature and the soft magnetic properties can be largely improved by heat treatment for a long time even at a temperature lower than the glass transition temperature, so that an amorphous magnetic member such as a ribbon or a dust core can be heat-treated simultaneously with a copper wire, a bobbin, a resin, and so on.

Now, description will be made of a second basic composition of an amorphous soft magnetic alloy of this invention further containing $(Ti_pC_qMn_rCu_s)$ in the foregoing first basic composition.

The present inventors have found that an amorphous soft magnetic alloy powder excellent in magnetic properties and amorphous-forming ability is obtained by selection so as to define an alloy composition having a composition formula of $(Fe_{1-\alpha}TM_{\alpha})_{100-w-x-y-z}P_wB_xL_ySi_z$ $(Ti_pC_qMn_rCu_s)$, wherein unavoidable impurity elements are contained, $0\leq\alpha\leq0.3$, $2\leq w\leq18$ at %, $2\leq x\leq18$ at %, $15\leq w+x\leq23$ at %, $1\leq y\leq5$ at %, $0\leq z\leq4$ at %, TM is at least one selected from Co and Ni, and L is at least one selected from the group consisting of Al, Cr, Mo, and Nb, $0\leq p\leq0.3$, $0\leq q\leq0.5$, $0\leq r\leq2$, and $0\leq s\leq1$, wherein p, q, r, and s each represents an additional ratio given that the totalmass of Fe, TM, P, B, L, Si is 100, and that high magnetic properties and excellent amorphous-forming ability can be obtained and the bulky, ember, thin ribbon, and powder made of an amorphous alloy having the composition can be obtained by working the alloy appropriately.

For example, an amorphous self magnetic alloy having the composition which has an excellent performance to exhibit an excellent amorphous forming ability, magnetic core can be obtained which has sizes of a thickness of 0.5 mm or more and a cross sectional area of 0.15 $mm^2$ or more, which sizes were not conventionally present and a high permeability over a wide frequency band and a high saturation magnetic flux density.

For example, in the case of the amorphous magnetic ribbon having the composition, the magnetic core having a similar magnetic property can be obtained by winding the ribbon and the magnetic core are formed by laminating the ribbons through insulators to improve them further in properties.

For example, in the case of the amorphous magnetic powder having the composition a dust core having a similar excellent property can be obtained by mixing the powder with a binder appropriately and molding using a molding die and by applying oxidation treatment or insulating coating to a surface of powder.

That is, this invention makes it possible to obtain an improved amorphous soft magnetic alloy powder excellent in magnetic properties, amorphous-forming ability, and powder filling properties by selection so as to define an alloy composition having a composition formula of $(Fe_{1-\alpha}TM_{\alpha})_{100-w-x-y-z}P_wB_xL_ySi_z(Ti_pC_qMn_rCu_s)$, wherein unavoidable impurity elements are contained, TM is at least one selected from Co and Ni, and L is at least one selected from the group consisting of Al, Cr, Mo, and Nb, $0\leq\alpha\leq0.3$, $2\leq w\leq18$ at %, $2\leq x\leq18$ at %, $15\leq w+x\leq23$ at %, $1\leq y\leq5$ at %, $0\leq z\leq4$ at %, $0\leq p\leq0.3$, $0\leq q\leq0.5$, $0\leq r\leq2$, and $0\leq s\leq1$, wherein p, q, r, and s each represents an additional ratio given that the totalmass of Fe, TM, P, B, L, Si is 100, and, further, since a dust core is produced using a molding die or the like to form the obtained powder applied with oxidation treatment or insulating coating into a molded product according to a proper forming method, there is obtained the high-permeability dust core adapted to exhibit excellent permeability properties over a wide frequency band, which was not conventionally present and, as a result, the high-frequency magnetic core made of the soft magnetic material with a high saturation magnetic flux density and a high resistivity can be produced at a low cost.

Herein, as an example of the basic composition 2 of this invention, there is provided an amorphous magnetic alloy expressed by the following composition formula, which is excellent in amorphous-forming ability and soft magnetic properties and has a supercooled liquid region.

That is, according to the example of the basic composition 2 of this invention, there is provided an amorphous soft magnetic alloy expressed by a composition formula of $(Fe_{1-\alpha}TM_{\alpha})_{100-w-x-y}P_wB_xL_ySi_z(Ti_pC_qMn_rCu_s)$, wherein TM is at least one selected from Co and Ni, and L is at least one selected from the group consisting of Al, Cr, Mo, and Nb, $0\leq\alpha\leq0.3$, $2\leq w\leq18$, $2\leq x\leq18$, $15\leq w+x\leq23$, $1\leq y\leq5$, $0\leq z\leq4$, $0\leq p\leq0.3$ mass %, $0\leq p\leq0.3$, $0\leq q\leq0.5$, $0\leq r\leq2$, and $0\leq s\leq1$, wherein p, q, r, and s each represents an additional ratio given that the totalmass of Fe, TM, P, B, L, Si is 100, and Tg (i.g. glass transition temperature) is 520° C. or less, Tx (i.g. crystallization start temperature) is 550° C. or less, and a supercooled liquid region represented by $\Delta Tx=Tx-Tg$ is 20° C. or more.

The amorphous soft magnetic alloy is characterized by having the foregoing composition and in that Tg (i.g. glass transition temperature) is 520° C. or less, Tx (i.g. crystallization start temperature) is 550° C. or less, and the supercooled liquid region represented by $\Delta Tx=Tx-Tg$ is 20° C. or more. Since Tg is 520° C. or less, the annealing effect is expected at a heat treatment temperature lower than conventional ones, so that it is possible to carry out heat treatment after winding a magnet wire. When the supercooled liquid region exceeds 20° C., excellent soft magnetic properties and amorphous-forming ability are exhibited. Further, the viscosity is rapidly reduced in the supercooled liquid region, thereby enabling machining utilizing viscous flow deformation.

According to this invention, the amorphous soft magnetic alloy has the first or the second basic composition with a Curie temperature of 240° C. or more. In the amorphous soft magnetic alloy, the magnetic properties are deteriorated at high temperatures if the Curie temperature is low. Therefore, the Curie temperature is limited to 240° C. or more.

Further, the present inventors have found that, by winding a coil with one or more turns around a high-frequency magnetic core made of the powder of the amorphous soft magnetic alloy having the foregoing basic composition 1 or 2, it is possible to produce a low-priced and high-performance inductance component that was not conventionally present.

Further, the present inventors have found that, by limiting the particle size of the amorphous soft magnetic metal powder expressed by the composition formula of the foregoing basic composition 1 or 2, there is obtained a dust core that is more excellent in magnetic core loss at high frequencies.

Further, the present inventors have found that, by integrating together a magnetic body and a wound coil by pressure molding in the state where the wound coil is enclosed in the magnetic body, there is obtained an inductance component adapted for large current at high frequencies.

Herein, the alloy powder may be thermally oxidized in the atmosphere before molding for increasing the resistivity of a molded product, it may be molded at a temperature equal to or higher than a softening point of a resin serving as a binder for obtaining a high-density molded product, or it may be molded in a supercooled liquid region of the alloy powder for further increasing the density of a molded product.

Specifically, the molded product is obtained by molding a mixture of the amorphous soft magnetic alloy powder having the foregoing basic composition 1 expressed by the composition formula of $(Fe_{1-\alpha}TM_{\alpha})_{100-w-x-y-z}P_wB_xL_ySi_z$, wherein unavoidable impurity elements are contained, $0\leq\alpha\leq0.98$, $2\leq w\leq16$ at %, $2\leq x\leq16$ at %, $0<y\leq10$ at %, $0\leq z\leq8$ at %, TM is at least one selected from Co and Ni, and L is at least one selected from the group consisting of Al, V, Cr, Y, Zr, Mo, Nb, Ta, and W, and a binder added in a predetermined amount in mass ratio to this amorphous soft magnetic alloy powder.

With respect to the amorphous soft magnetic alloy powder having the foregoing basic composition 2, its composition formula may be expressed by $(Fe_{1-\alpha}TM_{\alpha})_{100-w-x-y-z}P_wB_xL_ySi_z(Ti_pC_qMn_rCu_s)$, wherein unavoidable impurity elements are contained, $0\leq\alpha\leq0.3$, $2\leq w\leq18$ at %, $2\leq x\leq18$ at %, $15\leq w+x\leq23$ at %, $1\leq y\leq5$ at %, $0\leq z\leq4$ at %, $0\leq p\leq0.3$ mass %, $0\leq q\leq0.5$ mass %, $0\leq r\leq2$ mass %, $0\leq s\leq1$ mass %, TM is at least one selected from Co and Ni, and L is at least one selected from the group consisting of Al, Cr, Mo, and Nb).

Herein, the respective components of the alloy compositions of the amorphous soft magnetic metal powders of this invention will be described in detail.

Fe being the main component is an element that takes charge of magnetism and is essential for obtaining a high saturation magnetic flux density. Part of Fe can be replaced by Co or Ni represented by TM. In the case of Co, the content thereof is preferably 0.05 or more and 0.2 or less if the high saturation magnetic flux density is required. On the other hand, in the case of Ni, the addition thereof increases a supercooled liquid region while reduces Bs, and thus, the content thereof is preferably 0.1 or less. In terms of suppressing the material cost, it is preferable not to add Co or Ni which is high-priced.

P is an element essential in this invention and the content thereof is 2 at % or more and 18 at % or less, but 16 at % or less when Ti, C, Mn, and Cu are added. The reason for determining the content of P to be 2 at % or more and 18 at % or less or 16 at % or less is that when the content of P is less than 2 at %, the supercooled liquid region and the amorphous-forming ability are reduced, while, when it exceeds 18 at % or 16 at %, the Curie temperature, the supercooled liquid region, and the amorphous-forming ability are reduced. It is preferable that the content of P be set to 2 at % or more and 12 at % or less.

B is an element essential in this invention and the content thereof is 2 at % or more and 18 at % or less, but 16 at % or less when Ti, C, Mn, and Cu are added. The reason for determining the content of B to be 2 at % or more and 18 at % or less or 16 at % or less is that when the content of B is less than 2 at %, the Curie temperature, the supercooled liquid region, and the amorphous-forming ability are reduced, while, when it exceeds 18 at % or 16 at %, the supercooled liquid region and the amorphous-forming ability are reduced. It is preferable that the content of B be set to 6 at % or more and 16 at % or less.

When Ti, C, Mn, and Cu are added, the sum of the contents of P and B is 15 at % or more and 23 at % or less. The reason for determining the sum of the contents of P and B to be 15 at % or more and 23 at % or less is that when it is less than 15 at % or exceeds 23 at %, the supercooled liquid region and the amorphous-forming ability are reduced. The sum of the contents of P and B is preferably 16 at % or more and 22 at % or less.

L is an element that significantly improves the amorphous-forming ability of an Fe—P—B alloy and the content thereof is 10 at % or less, but is 5 at % or less when Ti, C, Mn, and Cu are added. The reason for determining the content of L to be 10 at % or less or 5 at % or less in this invention is that when it exceeds 10 at % or 5 at %, the saturation magnetic flux density and the Curie temperature are extremely reduced. The reason for determining the content of L exceeding 1% or 0% is that the amorphous phase cannot be formed when it is less than 1% or 0%.

Si is an element that can be substituted for P and B of an Fe—P—B alloy and improves the amorphous-forming ability, and the content thereof is 8 at % or less, but is 4 at % or less when Ti, C, Mn, and Cu are added. The reason for determining the content of Si to be 8 at % or less or 4 at % or less is that when it exceeds 8 at % or 4 at %, the glass transition temperature and the crystallization temperature rise while the supercooled liquid region and the amorphous-forming ability are reduced.

Ti, Mn, and Cu are elements effective for improving corrosion resistance of the alloy. The reason for determining the content of Ti to be 0.3 mass % or less is that when it exceeds 0.3 mass %, the amorphous-forming ability is extremely reduced. The reason for determining the content of Mn to be 2 mass % or less is that when it exceeds 2 mass %, the saturation magnetic flux density and the Curie temperature are extremely reduced. The reason for determining the content of Cu to be 1 mass % or less is that when it exceeds 1 mass %, the amorphous-forming ability is extremely reduced. C is an element effective for improving the Curie temperature of the alloy. The reason for determining the content of C to be 0.5 mass % or less is that when it exceeds 0.5 mass %, the amorphous-forming ability is extremely reduced like in the case of Ti.

The amorphous soft magnetic alloy powder is produced by a water atomizing method or a gas atomizing method and preferably has particle sizes of which at least 50% or more are 3 μm or more, and more preferably 10 μm or more. Particularly the water atomizing method is established as a method of manufacturing a large amount of alloy powder at a low price and it is industrially quite advantageous that the powder can be manufactured by this method. However, in the case of a conventional amorphous composition, an alloy powder having a particle size of 10 μm or more is crystallized and hence its magnetic properties are extremely deteriorated, and as a result, the product yield is extremely lowered, which has thus hindered industrialization thereof. On the other hand, since the alloy composition of the amorphous soft magnetic metal powder of this invention is easily amorphized when the particle size is 150 μm or less, the product yield is high, which is thus highly advantageous in terms of cost. In addition, since the alloy powder produced by the water atomizing method is already formed with a proper oxide film on the powder surfaces, a magnetic core with a high resistivity is easily obtained by mixing a resin into the alloy powder and forming a molded product. With respect to either of the alloy powder produced by the water atomizing method and the alloy powder produced by the gas atomizing method as described herein, if it is heat-treated in the atmosphere under a temperature condition equal to or less than a crystallization temperature thereof, there is an effect that a better oxide film is formed to thereby increase the resistivity of a magnetic core made of such an alloy powder. This can reduce a core loss of the magnetic core. On the other hand, with respect to a high-frequency inductance component, it is known that an eddy current loss can be reduced by the use of a fine particle size metal powder. However, in the case of a conventionally known alloy composition, there is a drawback that when the center particle size, e.g. average particle size, becomes 30 μm or less, the powder is significantly oxidized during production and, hence, it is difficult to obtain predetermined properties with the powder produced by a general water atomizing apparatus. On the other hand, since the amorphous soft magnetic metal powder is excellent in alloy corrosion resistance, it is advantageous that the powder having excellent properties with a small amount of oxygen can be manufactured relatively easily even when the powder is fine in particle size.

Basically, a high-frequency magnetic core is produced by mixing a binder, such as a silicone resin in an amount of 10% or less by mass into the amorphous soft magnetic metal powder and obtaining a molded product using a molding die or by molding.

A molded product may be obtained by compression-molding, in a molding die, a mixture of the amorphous soft magnetic metal powder and a binder added thereto in an amount of 5% or less by mass. In this case, the molded product has a powder filling ratio of 70% or more, a magnetic flux density of 0.4 T or more when a magnetic field of $1.6\times10^4$ A/m is applied, and a resistivity of 1 Ω·cm or more. When the magnetic flux density is 0.4 T or more and the resistivity is 1 Ω·cm or more, the molded product has better properties than a ferrite magnetic core and thus increases in usefulness.

Further, a molded product may be obtained by compression-molding, in a molding die under a temperature condition equal to or higher than a softening point of a binder, a mixture of the amorphous soft magnetic metal powder and the binder added thereto in an amount of 3% or less by mass. In this case, the molded product has a powder filling ratio of 80% or more, a magnetic flux density of 0.6 T or more when a magnetic field of $1.6\times10^4$ A/m is applied, and a resistivity of 0.1 Ω·cm or more. When the magnetic flux density is 0.6 T or more and the resistivity is 0.1 Ω·cm or more, the molded product has better properties than a currently commercialized dust core and thus further increases in usefulness. In addition, a molded product may be obtained by compression-molding, in the temperature range of the supercooled liquid region of the amorphous soft magnetic metal powder, a mixture of the amorphous soft magnetic metal powder and a binder added thereto in an amount of 1% or less by mass. In this case, the molded product has a powder filling ratio of 90% or more, a magnetic flux density of 0.9 T or more when a magnetic field of $1.6\times10^4$ A/m is applied, and a resistivity of 0.01 Ω·cm or more. When the magnetic flux density is 0.9 T or more and the resistivity is 0.01 Ω·cm or more, the molded product exhibits a magnetic flux density substantially equal to that of a laminated core of amorphous and high-silicon steel sheets in the practical use range. However, the molded product herein is smaller in hysteresis loss and much more excellent in core loss characteristics corresponding to its higher resistivity and thus further increases in usefulness as a magnetic core.

Moreover, if heat treatment is applied, as strain removal heat treatment, to each of the foregoing molded products serving as the high-frequency magnetic cores under a temperature condition equal to or higher than a Curie temperature thereof after the molding, the core loss further decreases and the usefulness as the magnetic core further increases.

In the powder produced from the amorphous soft magnetic alloy with the basic composition 1 or 2 of this invention, Tg (i.g. glass transition temperature) is 520° C. or less, Tx (i.g. crystallization start temperature) is 550° C. or less, and a supercooled liquid region represented by $\Delta Tx=Tx-Tg$ is 20° C. or more. Since Tg is 520° C. or less, the annealing effect is expected at a heat treatment temperature lower than conventional ones, so that it is possible to carry out heat treatment after winding a magnet wire. When the supercooled liquid region exceeds 20° C., excellent soft magnetic properties and amorphous-forming ability are exhibited. Further, the viscosity is rapidly reduced in the supercooled liquid region, thereby enabling machining utilizing viscous flow deformation.

Further, this invention may be an amorphous soft magnetic ribbon having an initial permeability of 5000 or more at a frequency of 1 kHz. Moreover, this invention may be formed as an amorphous bulk magnetic member having a thickness of 0.5 mm or more and a cross-sectional area of 0.15 $mm^2$ or more.

Herein, according to this invention, by selecting and optimizing the composition as described above, it is possible to produce an amorphous bulk magnetic member by a metal mold casting method, having a diameter of 1.5 mm and having an amorphous-forming ability that is much higher as compared with conventional amorphous ribbons, thereby enabling formation of a bulk member of a magnetic core which differs from lamination of ribbons or compaction molding of the powder.

By forming a gap at a portion of a magnetic path according to necessity and winding a coil with one or more turns around such a high-frequency magnetic core, it is possible to manufacture an inductance component as a product having excellent properties to exhibit a high magnetic permeability in a high magnetic field.

Now, this invention will be described in further detail with reference to the drawings.

Referring to FIG. 1, one example according to a basic structure of a high-frequency magnetic core 1 of this invention is shown in the state where the high-frequency magnetic core 1 is formed into an annular plate shape using the foregoing amorphous soft magnetic alloy powder.

Figure 2:
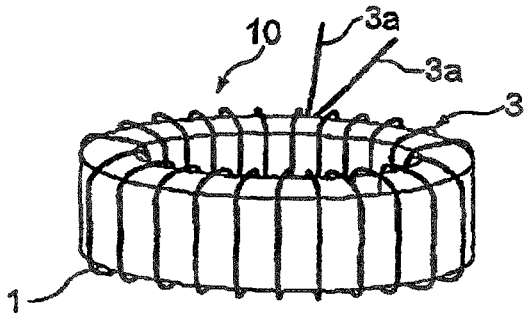
FIG. 2 is an external perspective view showing an inductance component formed by winding a coil around the high-frequency magnetic core shown in FIG. 1.

Referring to FIG. 2, an inductance component 10 formed by winding a coil 3 around the high-frequency magnetic core 1 is shown in the state where the coil 3 is wound a predetermined number of times around the annular plate shaped high-frequency magnetic core 1, thereby forming the inductance component 10 having lead drawn-out portions 3*a* and 3*b*.

Figure 3:
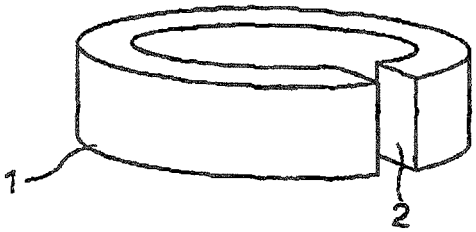
FIG. 3 is an external perspective view showing another example according to a basic structure of a high-frequency magnetic core of this invention.

Referring to FIG. 3, another example according to a basic structure of a high-frequency magnetic core 1 of this invention is shown in the state where the high-frequency magnetic core 1 is formed into an annular plate shape using the foregoing amorphous soft magnetic alloy powder and then is formed with a gap 2 at a portion of its magnetic path.

Figure 4:
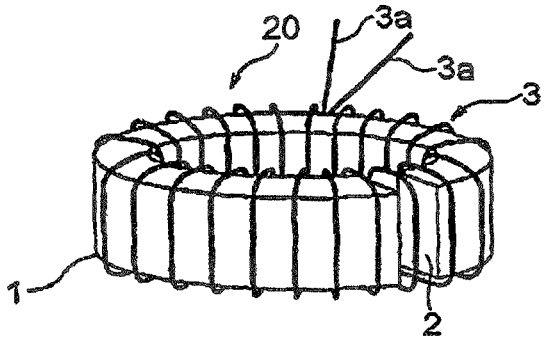
FIG. 4 is an external perspective view showing an inductance component formed by winding a coil around the high-frequency magnetic core shown in FIG. 3.

Referring to FIG. 4, an inductance component 20 formed by winding a coil 3 around the high-frequency magnetic core 1 having the gap 2 is shown in the state where the coil 3 is wound a predetermined number of times around the annular plate shaped high-frequency magnetic core 1 having the gap 2, thereby forming the inductance component 20 having lead drawn-out portions 3*a* and 3*b*.

A dust core having an excellent performance to exhibit extremely low-loss characteristics at high frequencies, which was not conventionally present, is obtained by molding a mixture of an amorphous soft magnetic metal powder having the foregoing amorphous metal composition and having a maximum particle size of 45 μm or less by sieve size and a center particle size of 30 μm or less and a binder added thereto in an amount of 10% or less by mass. By applying a coil to such a dust core, an inductance component is obtained which is excellent in Q characteristic. Further, by integrating together a magnetic body and a wound coil by pressure molding in the state where the wound coil is enclosed in the magnetic body, an inductance component is obtained which is adapted for large current at high frequencies.

The specific reason for defining the powder particle size is that if the maximum particle size exceeds 45 μm by sieve size, the Q characteristic in a high-frequency region is deteriorated and, further, unless the center particle size is 30 μm or less, the Q characteristic at 500 kHz or more does not exceed 40. Further, unless the center particle size is 20 μm or less, the Q value (1/tan δ) at 1 MHz or more does not become 50 or more. Since the resistivity of the alloy itself of the amorphous soft magnetic alloy powder is about 2 to 10 times higher as compared with conventional materials, it is advantageous that the Q characteristic becomes higher with the same particle size. If it does not matter whether or not the Q characteristic is the same, the powder manufacturing cost can be reduced by increasing a usable particle size range.

Figure 5:
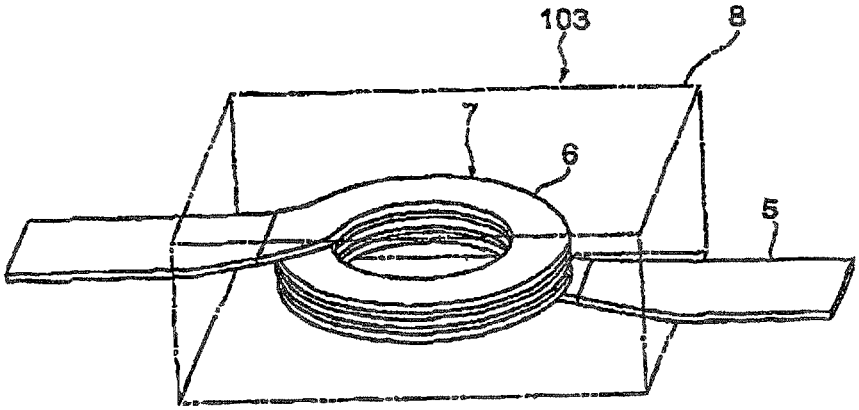
FIG. 5 is an external perspective view showing still another example according to a basic structure of a high-frequency magnetic core of this invention.

Referring to FIG. 5, another example according to a basic structure of a high-frequency inductance component 103 of this invention is shown in the state where the inductance component 103 is formed by integrating together a magnetic body 8 and a wound coil element 7 made of the foregoing amorphous soft magnetic alloy powder, by pressure molding in the state where a wound coil 6 is enclosed in the magnetic body 8. Numeral "5" represents a coil drawn-out portion extending from the wound coil 6.

In this invention, "amorphous" represents a state where an X-ray diffraction (XRD) profile obtained by measuring the surface of a ribbon or powder by a normal X-ray diffraction method shows only a broad peak. On the other hand, when a sharp peak due to the crystal phase is present, it is judged "crystal phase".

In this invention, when a ribbon or powder in the amorphous state is raised in temperature in an inert atmosphere, such as an Ar gas atmosphere, a crystallization phenomenon occurs after appearance of a glass transition phenomenon during the temperature rise. A start temperature of this glass transition phenomenon is given as a glass transition temperature (Tg) and a temperature range between the glass transition temperature (Tg) and a crystallization temperature (Tx) is given as a supercooled liquid region (Tx-Tg). Glass transition temperatures, crystallization temperatures, and supercooled liquid regions were evaluated under the condition where the heating rate was set to 40 K/min.

EXAMPLES

Hereinbelow, this invention will be described in detail in terms of Examples.

Examples 1 to 15

Pure metal materials of Fe, P, B, Al, V, Cr, Y, Zr, Nb, Mo, Ta, and W were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons respectively having thicknesses of 20 μm and 200 μm were produced using a single-roll method by adjusting the revolution speed.

For comparison, a mother alloy having the same composition as that of commercialized METGLAS 2605-S2 was produced by high-frequency heating and then formed into 20 μm and 200 μm ribbons by the single-roll method.

With respect to each of the 200 μm ribbons, a free solidified surface with the slowest cooling rate, which was not in contact with a copper roll, was measured using the X-ray diffraction method, thereby obtaining an X-ray diffraction profile, and it was judged "amorphous phase" when the obtained X-ray diffraction profile showed only a broad peak, while it was judged "crystal phase" otherwise. Further, using the 20 μm ribbons, thermal properties were evaluated by a differential scanning calorimeter or calorimetry (DSC). In accordance therewith, glass transition temperatures and crystallization temperatures were measured and supercooled liquid regions were calculated therefrom. With respect to the magnetic properties, the 20 μm ribbons were formed into wound magnetic cores, then initial permeabilities were measured by an impedance analyzer and coercive forces were measured by a dc B—H tracer. In this event, the respective samples were heat-treated in an Ar atmosphere at the glass transition temperature for 5 minutes. Those samples with no glass transition temperatures were each heat-treated at a temperature lower by 30° C. from the crystallization temperature for 5 minutes.

TABLE 1

| | alloy composition at % | ribbon 200 μm | Tc ° C. | T ° C. | Tx ° C. | Tx − Tg ° C. | Bs T | initial permeability 1 kHz |
|---|---|---|---|---|---|---|---|---|
| Comparative Example 1 | $Fe_{78}P_0B_{18}Mo_4$ | crystal phase | 262 | 490 | 514 | 24 | 1.27 | 4000 |
| Example 1 | $Fe_{78}P_2B_{16}Mo_4$ | amorphous phase | 261 | 485 | 514 | 29 | 1.29 | 8000 |
| Example 2 | $Fe_{78}P_8B_{10}Mo_4$ | amorphous phase | 256 | 466 | 506 | 40 | 1.28 | 15000 |
| Example 3 | $Fe_{78}P_{16}B_2Mo_4$ | amorphous phase | 250 | 456 | 496 | 40 | 1.27 | 12000 |
| Comparative Example 2 | $Fe_{78}P_{18}B_0Mo_4$ | crystal phase | 250 | — | 490 | — | 1.25 | 3500 |
| Comparative Example 3 | $Fe_{82}P_8B_{10}Mo_0$ | crystal phase | 342 | 440 | 458 | 18 | 1.61 | 4000 |
| Example 4 | $Fe_{81}P_8B_{10}Mo$ | amorphous phase | 318 | 446 | 477 | 31 | 1.53 | 5500 |
| Example 5 | $Fe_{78}P_8B_{10}Mo_4$ | amorphous phase | 256 | 466 | 506 | 40 | 1.28 | 15000 |
| Example 6 | $Fe_{78}P_8B_{10}Mo_5$ | amorphous phase | 242 | 480 | 520 | 40 | 1.20 | 14000 |
| Example 7 | $Fe_{72}P_8B_{10}Mo_{10}$ | amorphous phase | 178 | 513 | 538 | 25 | 0.76 | 6000 |
| Comparative Example 4 | $Fe_{70}P_8B_{10}Mo_{12}$ | crystal phase | 162 | — | 552 | — | 0.44 | 4500 |
| Example 8 | $Fe_{78}P_8B_{10}Al_4$ | amorphous phase | 365 | 456 | 487 | 31 | 1.53 | 7000 |
| Example 9 | $Fe_{78}P_8B_{10}V_4$ | amorphous phase | 260 | 463 | 495 | 32 | 1.36 | 8000 |
| Example 10 | $Fe_{78}P_8B_{10}Cr_4$ | amorphous phase | 259 | 454 | 480 | 26 | 1.31 | 7000 |
| Example 11 | $Fe_{78}P_8B_{10}Y_4$ | amorphous phase | 292 | 482 | 507 | 25 | 1.29 | 6000 |
| Example 12 | $Fe_{78}P_8B_{10}Zr_4$ | amorphous phase | 259 | 470 | 502 | 32 | 1.28 | 9000 |
| Example 13 | $Fe_{78}P_8B_{10}Nb_4$ | amorphous phase | 258 | 476 | 516 | 40 | 1.27 | 17000 |
| Example 14 | $Fe_{78}P_8B_{10}Ta_4$ | amorphous phase | 252 | 504 | 546 | 42 | 1.25 | 15000 |
| Example 15 | $Fe_{78}P_8B_{10}W_4$ | amorphous phase | 246 | 486 | 529 | 43 | 1.23 | 13000 |

TABLE 1-continued

| | alloy composition at % | ribbon 200 μm | Tc ° C. | T ° C. | Tx ° C. | Tx − Tg ° C. | Bs T | initial permeability 1 kHz |
|---|---|---|---|---|---|---|---|---|
| Comparative Example 5 | METGLAS | crystal phase | 400 | — | 525 | — | 1.58 | 4000 |

Figure 6:
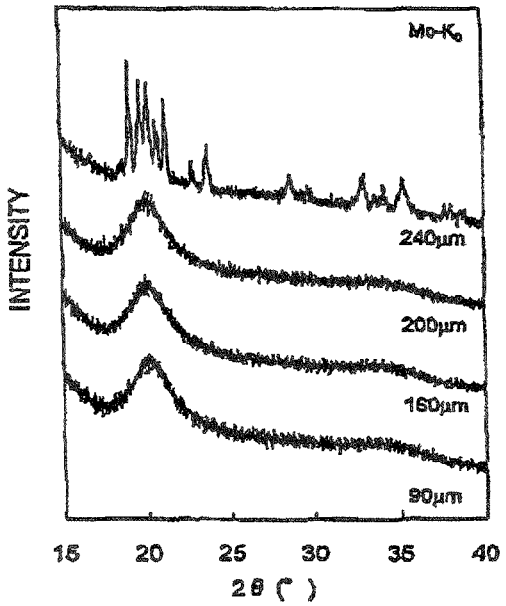
FIG. 6 is a diagram showing XRD results of $Fe_{78}P_8B_{10}Mo_4$ ribbons having different thicknesses according to X-ray diffraction (XRD) method.

As shown in Table 1, since the alloy compositions of Examples 1 to 15 fall within the composition range of this invention, they respectively have supercooled liquid regions and are excellent in glass forming ability and soft magnetic properties. FIG. 6 shows XRD results of $Fe_{78}P_8B_{10}Mo_4$ ribbons having different thicknesses. It is understood from FIG. 6 that the X-ray diffraction profile shows only a broad peak up to 200 μm, thus exhibiting "amorphous phase". This also applies to the other Examples. From a practical point of view, it is difficult to produce a ribbon having a thickness of 1 μm or less. On the other hand, Comparative Examples 2, 4, and 5 have no supercooled liquid regions and are poor in glass forming ability and soft magnetic properties. Comparative Examples 1 and 3 each have a supercooled liquid region although it is small, but the glass forming ability is low and it is not possible to produce a ribbon having a thickness of 200 μm or more.

Examples 16 to 24

Pure metal materials of Fe, P, B, Al, V, Cr, Nb, Mo, Ta, W, and Si were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons respectively having thicknesses of 20 μm and 200 μm were produced by the use of the single-roll method by adjusting the revolution speed.

With respect to each of the 200 μm ribbons, a free solidified surface with the slowest cooling rate, which was not in contact with a copper roll, was measured by the use of the X-ray diffraction method, thereby obtaining an X-ray diffraction profile, and it was judged "amorphous phase" when the obtained X-ray diffraction profile showed only a broad peak, while it was judged "crystal phase" otherwise. Further, using the 20 μm ribbons, thermal properties were evaluated by DSC. In accordance therewith, glass transition temperatures and crystallization temperatures were measured and supercooled liquid regions were calculated therefrom. With respect to the magnetic properties, the 20 μm ribbons were formed into wound magnetic cores, then initial permeabilities were measured by an impedance analyzer and coercive forces were measured by a dc B—H tracer. In this event, the respective samples were heat-treated in an Ar atmosphere at the glass transition temperature for 5 minutes. Those samples with no glass transition temperatures were each heat-treated at a temperature lower by 30° C. from the crystallization temperature for 5 minutes.

TABLE 2

| | alloy composition at % | ribbon 200 μm | Tc ° C. | Tg ° C. | Tx ° C. | Tx − Tg ° C. | Bs T | initial permeability 1 kHz |
|---|---|---|---|---|---|---|---|---|
| Example 16 | $Fe_{78}P_8B_{10}Si_0Mo_4$ | amorphous phase | 255 | 466 | 506 | 40 | 1.28 | 15000 |
| Example 17 | $Fe_{78}P_7B_9Si_2Mo_4$ | amorphous phase | 257 | 472 | 508 | 36 | 1.27 | 13000 |
| Example 18 | $Fe_{78}P_3B_9Si_8Mo_4$ | amorphous phase | 262 | 489 | 509 | 20 | 1.27 | 9000 |
| Comparative Example 6 | $Fe_{78}P_2B_8Si_{10}Mo_4$ | amorphous phase | 262 | — | 522 | — | 1.26 | 4500 |
| Example 19 | $Fe_{78}P_7B_9Si_2Al_4$ | amorphous phase | 367 | 464 | 497 | 33 | 1.55 | 8000 |
| Example 20 | $Fe_{78}P_7B_9Si_2V_4$ | amorphous phase | 265 | 467 | 505 | 38 | 1.39 | 7500 |
| Example 21 | $Fe_{78}P_7B_9Si_2Cr_4$ | amorphous phase | 262 | 466 | 501 | 35 | 1.30 | 6500 |
| Example 22 | $Fe_{78}P_7B_9Si_2Nb_4$ | amorphous phase | 262 | 480 | 518 | 38 | 1.24 | 14000 |
| Example 23 | $Fe_{78}P_7B_9Si_2Ta_4$ | amorphous phase | 253 | 485 | 522 | 37 | 1.22 | 12000 |
| Example 24 | $Fe_{78}P_7B_9Si_2W_4$ | amorphous phase | 249 | 497 | 541 | 44 | 1.20 | 11000 |

As shown in Table 2, since the alloy compositions of Examples 16 to 24 fall within the composition range of this invention, they respectively have supercooled liquid regions and are excellent in glass forming ability and soft magnetic properties. On the other hand, Comparative Example 6 has no supercooled liquid region and is low in glass forming ability and thus it is not possible to produce a ribbon having a thickness of 200 μm or more, and further, Comparative Example 6 is poor in soft magnetic properties.

As shown in Table 3, since the alloy compositions of Examples 25 to 29 fall within the composition range of this invention, they respectively have supercooled liquid regions and are excellent in glass forming ability and soft magnetic properties. On the other hand, although Comparative Example 7 has a supercooled liquid region and is excellent in glass forming ability, it exhibits no magnetism at room temperature.

TABLE 3

| | alloy composition at % | ribbon 200 μm | Tc ° C. | Tg ° C. | Tx ° C. | Tx − Tg ° C. | Bs T | initial permeability 1 kHz |
|---|---|---|---|---|---|---|---|---|
| Example 25 | $(Fe_{1.0}Co_{0.0})_{78}P_8B_{10}Mo_4$ | amorphous phase | 255 | 466 | 506 | 40 | 1.28 | 15000 |
| Example 26 | $(Fe_{0.8}Co_{0.2})_{78}P_8B_{10}Mo_4$ | amorphous phase | 278 | 468 | 510 | 42 | 1.28 | 14000 |
| Example 27 | $(Fe_{0.8}Ni_{0.2})_{78}P_8B_{10}Mo_4$ | amorphous phase | 251 | 462 | 511 | 49 | 1.20 | 16000 |
| Example 28 | $(Fe_{0.1}Co_{0.9})_{78}P_8B_{10}Mo_4$ | amorphous phase | 243 | 470 | 512 | 42 | 0.45 | 40000 |
| Example 29 | $(Fe_{0.05}N_{0.05}Co_{0.9})_{78}P_8B_{10}Mo_4$ | amorphous phase | 245 | 469 | 508 | 39 | 0.41 | 68000 |
| Comparative Example 7 | $(Fe_{0.9}Ni_{1.0})_{78}P_8B_{10}Mo_4$ | amorphous phase | — | 460 | 508 | 48 | 0 | — |

Examples 25 to 29

Pure metal materials of Fe, Co, Ni, P, B, and Mo were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons respectively having thicknesses of 20 μm and 200 μm were produced using the single-roll method by adjusting the revolution speed.

With respect to each of the 200 μm ribbons, a free solidified surface with the slowest cooling rate, which was not in contact with a copper roll, was measured using the X-ray diffraction method, thereby obtaining an X-ray diffraction profile, and it was judged "amorphous phase" when the obtained X-ray diffraction profile showed only a broad peak, while it was judged "crystal phase" otherwise. Further, by the use of the 20 μm ribbons, thermal properties were evaluated by DSC. In accordance therewith, glass transition temperatures and crystallization temperatures were measured and supercooled liquid regions were calculated therefrom. With respect to the magnetic properties, the 20 μm ribbons were formed into wound magnetic cores, then initial permeabilities were measured by an impedance analyzer and coercive forces were measured by a dc B—H tracer. In this event, the respective samples were heat-treated in an Ar atmosphere at the glass transition temperature for 5 minutes. Those samples with no glass transition temperatures were each heat-treated at a temperature lower by 30° C. from the crystallization temperature for 5 minutes.

Examples 30 to 33

Pure metal materials of Fe, Co, Ni, P, B, Mo, and Si were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons respectively having thicknesses of 20 μm and 200 μm were produced using the single-roll method by adjusting the revolution speed.

With respect to each of the 200 μm ribbons, a free solidified surface with the slowest cooling rate, which was not in contact with a copper roll, was measured using the X-ray diffraction method, thereby obtaining an X-ray diffraction profile, and it was judged "amorphous phase" when the obtained X-ray diffraction profile showed only a broad peak, while it was judged "crystal phase" otherwise. Further, using the 20 μm ribbons, thermal properties were evaluated by DSC. In accordance therewith, glass transition temperatures and crystallization temperatures were measured and supercooled liquid regions were calculated therefrom. With respect to the magnetic properties, the 20 μm ribbons were formed into wound magnetic cores, then initial permeabilities were measured by an impedance analyzer and coercive forces were measured by a dc B—H tracer. In this event, the respective samples were heat-treated in an Ar atmosphere at the glass transition temperature for 5 minutes. Those samples with no glass transition temperatures were each heat-treated at a temperature lower by 30° C. from the crystallization temperature for 5 minutes.

TABLE 4

| | alloy composition at % | ribbon 200 μm | Tc ° C. | Tg ° C. | Tx ° C. | Tx − Tg ° C. | Bs T | initial permeability 1 kHz |
|---|---|---|---|---|---|---|---|---|
| Example 30 | $(Fe_{1.0}Co_{0.0})_{78}P_7B_9Si_2Mo_4$ | amorphous phase | 257 | 472 | 508 | 36 | 1.27 | 13000 |
| Example 31 | $(Fe_{0.8}Co_{0.2})_{78}P_7B_9Si_2Mo_4$ | amorphous phase | 281 | 474 | 510 | 36 | 1.28 | 6500 |
| Example 32 | $(Fe_{0.8}Ni_{0.2})_{78}P_7B_9Si_2Mo_4$ | amorphous phase | 250 | 466 | 513 | 47 | 1.17 | 10000 |
| Example 33 | $(Fe_{0.05}Ni_{0.05}Co_{0.9})_{78}P_7B_9Si_2Mo_4$ | amorphous phase | 245 | 478 | 517 | 39 | 0.41 | 70000 |
| Comparative Example 8 | $(Fe_{0.0}Ni_{1.0})_{78}P_7B_9Si_2Mo_4$ | amorphous phase | 246 | 455 | 493 | 38 | 0 | — |

As shown in Table 4, since the alloy compositions of Examples 30 to 33 fall within the composition range of this invention, they respectively have supercooled liquid regions and are excellent in glass forming ability and soft magnetic properties. On the other hand, although Comparative Example 8 has a supercooled liquid region and is excellent in glass forming ability, it exhibits no magnetism at room temperature.

Examples 34 to 36

Pure metal materials of Fe, P, B, Al, Nb, and Mo were respectively weighed according to predetermined alloy compositions and then melted by high-frequency heating in a reduced-pressure Ar atmosphere in a chamber after evacuation, thereby producing mother alloys. Thereafter, by the use of the produced mother alloys, amorphous soft magnetic powders were produced by the water atomizing method.

For comparison, a mother alloy having the same composition as that of commercialized METGLAS 2605-S2 was produced by high-frequency heating and then formed into an amorphous soft magnetic powder by the water atomizing method.

The obtained amorphous soft magnetic powders were each classified into particle sizes of 200 μm or less and then measured using the X-ray diffraction method, thereby obtaining X-ray diffraction profiles, and it was judged "amorphous phase" when the obtained X-ray diffraction profile showed only a broad peak, while it was judged "crystal phase" otherwise.

TABLE 5

| | alloy composition at % | powder −200 μm |
|---|---|---|
| Example 34 | $Fe_{78}P_6B_{12}Mo_4$ | amorphous phase |
| Example 35 | $Fe_{78}P_6B_{12}Al_4$ | amorphous phase |
| Example 36 | $Fe_{78}P_6B_{12}Nb_4$ | amorphous phase |
| Comparative Example 9 | METGLAS | crystal phase |

Figure 7:
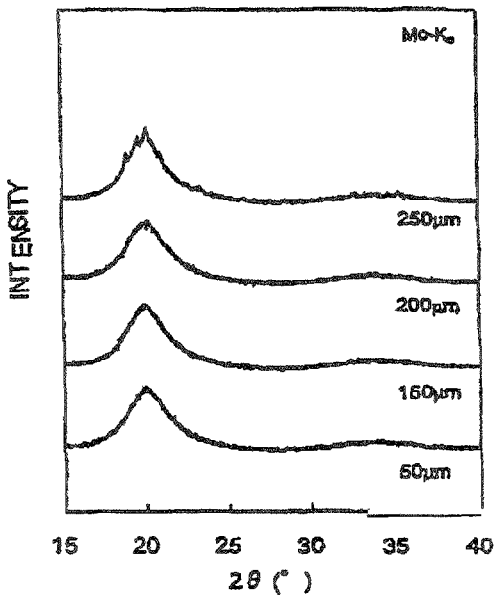
FIG. 7 is a diagram showing results of $Fe_{78}P_8B_{10}Mo_4$ powders having different particle sizes according to XRD method.

As shown in Table 5, since the alloy compositions of Examples 34 to 36 fall within the composition range of this invention, it is possible to produce the amorphous soft magnetic powders by the water atomizing method. FIG. 7 shows XRD results of $Fe_{78}P_8B_{10}Mo_4$ powders having different particle sizes through classification. It is understood from FIG. 7 that the X-ray diffraction profile shows only a broad peak up to 200 μm, thus exhibiting "amorphous phase". This also applies to the other Examples. On the other hand, Comparative Example 9 has no glass forming ability and thus the obtained powder is in the crystal phase. It was not possible to obtain an amorphous soft magnetic powder.

Examples 37 to 60

Materials of Fe, Co, Ni, Fe—P, Fe—B, Fe—Si, Al, Fe—V, Fe—Cr, Y, Zr, Fe—Nb, Fe—Mo, Ta, W, Ti, C, Mn, and Cu were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons respectively having thicknesses of 20 μm and 200 μm were produced by the use of the single-roll method by adjusting the revolution speed.

For comparison, a mother alloy having the same composition as that of commercialized METGLAS 2605-S2 was produced by high-frequency heating and then formed into 20 μm and 200 μm ribbons by the single-roll method.

With respect to each of the 200 μm ribbons, a free solidified surface with the slowest cooling rate, which was not in contact with a copper roll, was measured using the X-ray diffraction method, thereby obtaining an X-ray diffraction profile, and it was judged "amorphous phase" when the obtained X-ray diffraction profile showed only a broad peak, while it was judged "crystal phase" otherwise. Further, using the 20 μm ribbons, thermal properties were evaluated by DSC. In accordance therewith, glass transition temperatures and crystallization temperatures were measured and supercooled liquid regions were calculated therefrom. With respect to the magnetic properties, the 20 μm ribbons were used and saturation magnetic flux densities thereof were measured using a vibrating sample magnetometer (VSM).

TABLE 6-1

| | alloy composition at % | additive wt % | ribbon 200 μm | Tc ° C. | Tg ° C. | Tx ° C. | Tx − Tg ° C. | Bs T | initial permeability 1 kHz |
|---|---|---|---|---|---|---|---|---|---|
| Example 37 | $Fe_{77}P_{10}B_{10}Nb_2Cr_1$ | $Ti_0C_0Mn_0Cu_0$ | amorphous phase | 280 | 480 | 514 | 34 | 1.31 | 12500 |
| Example 38 | $Fe_{77}P_{10}B_{10}Nb_2Cr_1$ | $Ti_{0.1}C_{0.1}Mn_{0.1}Cu_{0.1}$ | amorphous phase | 278 | 481 | 517 | 36 | 1.30 | 10500 |
| Comparative Example 10 | $Fe_{77}P_1B_{19}Nb_2Cr_1$ | $Ti_{0.1}C_{0.1}Mn_{0.1}Cu_{0.1}$ | crystal phase | 285 | 525 | 543 | 18 | 1.35 | 4000 |
| Example 39 | $Fe_{77}P_2B_{18}Nb_2Cr_1$ | $Ti_{0.1}C_{0.1}Mn_{0.1}Cu_{0.1}$ | amorphous phase | 285 | 518 | 539 | 21 | 1.33 | 6500 |
| Example 40 | $Fe_{77}P_{18}B_2Nb_2Cr_1$ | $Ti_{0.1}C_{0.1}Mn_{0.1}Cu_{0.1}$ | amorphous phase | 242 | 452 | 474 | 22 | 1.25 | 5500 |
| Comparative Example 11 | $Fe_{77}P_{19}B_1Nb_2Cr_1$ | $Ti_{0.1}C_{0.1}Mn_{0.1}Cu_{0.1}$ | crystal phase | 234 | 442 | 458 | 16 | 1.24 | 4500 |
| Example 41 | $Fe_{69}P_{10}B_{10}Nb_{10}Cr_1$ | $Ti_{0.1}C_{0.1}Mn_{0.1}Cu_{0.1}$ | amorphous phase | 168 | 517 | 548 | 22 | 0.70 | 5000 |
| Comparative Example 12 | $Fe_{68}P_{10}B_{10}Nb_{11}Cr_1$ | $Ti_{0.1}C_{0.1}Mn_{0.1}Cu_{0.1}$ | crystal phase | 154 | 522 | 550 | 18 | 0.45 | 4000 |
| Example 42 | $Fe_{77}P_6B_6Si_8Nb_2Cr_1$ | $Ti_{0.1}C_{0.1}Mn_{0.1}Cu_{0.1}$ | amorphous phase | 283 | 519 | 533 | 24 | 1.34 | 8000 |
| Comparative Example 13 | $Fe_{77}P_5B_5Si_{10}Nb_2Cr_1$ | $Ti_{0.1}C_{0.1}Mn_{0.1}Cu_{0.1}$ | crystal phase | 287 | — | 555 | 19 | 1.34 | 5500 |
| Example 43 | $Fe_{77}P_{10}B_{10}Nb_2Al_1$ | $Ti_{0.1}C_{0.1}Mn_{0.1}Cu_{0.1}$ | amorphous phase | 266 | 476 | 502 | 26 | 1.43 | 8500 |
| Example 44 | $Fe_{77}P_{10}B_{10}Nb_2Cr_1$ | $Ti_{0.1}C_{0.1}Mn_{0.1}Cu_{0.1}$ | amorphous phase | 252 | 485 | 514 | 29 | 1.33 | 11000 |
| Example 45 | $Fe_{77}P_{10}B_{10}Mo_2Al_1$ | $Ti_{0.1}C_{0.1}Mn_{0.1}Cu_{0.1}$ | amorphous phase | 258 | 482 | 516 | 34 | 1.39 | 9500 |
| Example 46 | $Fe_{77}P_{10}B_{10}Mo_2Cr_1$ | $Ti_{0.1}C_{0.1}Mn_{0.1}Cu_{0.1}$ | amorphous phase | 245 | 489 | 524 | 35 | 1.28 | 11500 |
| Example 47 | $Fe_{77}P_{10}B_{10}Al_2Cr_1$ | $Ti_{0.1}C_{0.1}Mn_{0.1}Cu_{0.1}$ | amorphous phase | 315 | 468 | 491 | 23 | 1.52 | 6500 |
| Example 48 | $Fe_{77}P_{10}B_{10}V_2C_1$ | $Ti_{0.1}C_{0.1}Mn_{0.1}Cu_{0.1}$ | amorphous phase | 260 | 470 | 495 | 25 | 1.35 | 6000 |
| Example 49 | $Fe_{77}P_{10}B_{10}Y_2Cr_1$ | $Ti_{0.1}C_{0.1}Mn_{0.1}Cu_{0.1}$ | amorphous phase | 271 | 483 | 513 | 30 | 1.37 | 7500 |
| Example 50 | $Fe_{77}P_{10}B_{10}Zr_2Cr_1$ | $Ti_{0.1}C_{0.1}Mn_{0.1}Cu_{0.1}$ | amorphous phase | 267 | 482 | 508 | 26 | 1.36 | 8500 |
| Example 51 | $Fe_{77}P_{10}B_{10}Ta_2Cr_1$ | $Ti_{0.1}C_{0.1}Mn_{0.1}Cu_{0.1}$ | amorphous phase | 251 | 486 | 524 | 28 | 1.32 | 10500 |
| Example 52 | $Fe_{77}P_{10}B_{10}W_2Cr_1$ | $Ti_{0.1}C_{0.1}Mn_{0.1}Cu_{0.1}$ | amorphous phase | 243 | 490 | 527 | 37 | 1.28 | 9500 |
| Comparative Example 14 | $Fe_{77}P_{10}B_{10}Nb_2Cr_1$ | $Ti_{0.4}C_{0.1}Mn_{0.1}Cu_{0.1}$ | crystal phase | 272 | 483 | 502 | 19 | 1.28 | 6000 |
| Example 53 | $Fe_{77}P_{10}B_{10}Nb_2Cr_1$ | $Ti_{0.1}C_{0.3}Mn_{0.1}Cu_{0.1}$ | amorphous phase | 288 | 482 | 515 | 33 | 1.32 | 7000 |
| Example 54 | $Fe_{77}P_{10}B_{10}Nb_2Cr_1$ | $Ti_{0.1}C_{0.5}Mn_{0.1}Cu_{0.1}$ | amorphous phase | 295 | 482 | 504 | 22 | 1.32 | 5500 |

TABLE 6-2

| | alloy composition at % | additive wt % | ribbon 200 μm | Tc ° C. | Tg ° C. | Tx ° C. | Tx − Tg ° C. | Bs T | initial permeability 1 kHz |
|---|---|---|---|---|---|---|---|---|---|
| Comparative Example 15 | $Fe_{77}P_{10}B_{10}Nb_2Cr_1$ | $Ti_{0.1}C_{0.6}Mn_{0.1}Cu_{0.1}$ | crystal phase | 301 | 486 | 498 | 12 | 1.35 | 4000 |
| Example 55 | $Fe_{77}P_{10}B_{10}Nb_2Cr_1$ | $Ti_{0.1}C_{0.1}Mn_{1.0}Cu_{0.1}$ | amorphous phase | 263 | 481 | 517 | 36 | 1.26 | 12000 |
| Example 56 | $Fe_{77}P_{10}B_{10}Nb_2Cr_1$ | $Ti_{0.1}C_{0.1}Mn_{2.0}Cu_{0.1}$ | amorphous phase | 248 | 481 | 516 | 35 | 1.20 | 12500 |
| Comparative Example 16 | $Fe_{77}P_{10}B_{10}Nb_2Cr_1$ | $Ti_{0.1}C_{0.1}Mn_{3.0}Cu_{0.1}$ | amorphous phase | 229 | 479 | 515 | 36 | 1.11 | 10000 |
| Example 57 | $Fe_{77}P_{10}B_{10}Nb_2Cr_1$ | $Ti_{0.1}C_{0.1}Mn_{0.1}Cu_{0.5}$ | amorphous phase | 281 | 480 | 515 | 35 | 1.30 | 7000 |
| Example 58 | $Fe_{77}P_{10}B_{10}Nb_2Cr_1$ | $Ti_{0.1}C_{0.1}Mn_{0.1}Cu_{1.0}$ | amorphous phase | 280 | 481 | 511 | 30 | 1.28 | 5500 |
| Comparative Example 17 | $Fe_{77}P_{10}B_{10}Nb_2Cr_1$ | $Ti_{0.1}C_{0.1}Mn_{0.1}Cu_{1.2}$ | crystal phase | 285 | 480 | 492 | 12 | 1.29 | 4500 |
| Example 59 | $(Fe_{0.8}Co_{0.2})_{77}P_{10}B_{10}Nb_2Cr_1$ | $Ti_{0.1}C_{0.1}Mn_{0.1}Cu_{0.1}$ | amorphous phase | 290 | 479 | 508 | 29 | 1.34 | 12000 |
| Comparative Example 18 | $(Fe_{0.8}Ni_{0.2})_{77}P_{10}B_{10}Nb_2Cr_1$ | $Ti_{0.1}C_{0.1}Mn_{0.1}Cu_{0.1}$ | amorphous phase | 265 | 476 | 516 | 40 | 1.34 | 13500 |
| Example 60 | $(Fe_{0.1}Co_{0.9})_{77}P_{10}B_{10}Nb_2Cr_1$ | $Ti_{0.1}C_{0.1}Mn_{0.1}Cu_{0.1}$ | amorphous phase | 262 | 482 | 508 | 26 | 0.63 | 60000 |
| Comparative Example 19 | $(Fe_{0.0}Ni_{1.0})_{77}P_{10}B_{10}Nb_2Cr_1$ | $Ti_{0.1}C_{0.1}Mn_{0.1}Cu_{0.1}$ | amorphous phase | — | 465 | 509 | 44 | — | — |
| Comparative Example 20 | METGLAS | | crystal phase | 400 | — | 525 | — | 1.58 | 4000 |

As shown in Table 6-1 and Table 6-2, since the alloy compositions of Examples 37 to 60 fall within the composition range of this invention, they respectively have supercooled liquid regions and are excellent in amorphous-forming ability and soft magnetic properties. On the other hand, Comparative Examples 10, 11, 12, 13, 14, 15, 17, and 20 have only small or no supercooled liquid regions and are poor in amorphous-forming ability. Comparative Examples 16, 18, and 19 are good in amorphous-forming ability, but Tc and Bs are low. In Comparative Example 15, the supercooled liquid region is small, the amorphous-forming ability is poor, and further, the glass transition temperature is high.

Examples 61 to 70

Materials of Fe, Fe—P, Fe—B, Fe—Cr, Fe—Nb, Ti, C, Mn, and Cu were respectively weighed according to predetermined alloy compositions and then melted by high-frequency heating in a reduced-pressure Ar atmosphere in a chamber after evacuation, thereby producing mother alloys.

Thereafter, by the use of the produced mother alloys, ribbons each having a thickness of 50 μm were produced using the single-roll method.

For comparison, a mother alloy having the same composition as that of commercialized METGLAS 2605-S2 was produced by high-frequency heating and then formed into a 50 μm ribbon by the single-roll method.

Corrosion rates were examined for the respective ribbons. The 50 μm ribbon was put into a 1 normal NaCl solution and a change in weight was examined, and the corrosion rate was calculated from the surface area and time. Results thereof are shown in Table 7.

As shown in Table 7, since the alloy compositions of Examples 61 to 70 fall within the composition range of this invention, they are excellent in corrosion resistance, i.e. their corrosion rates are low. On the other hand, Comparative Example 21 is poor in corrosion resistance, i.e. its corrosion rate is large.

TABLE 7

| | alloy composition at % | additive wt % | corrosion rate 1N NaCl mm/year |
|---|---|---|---|
| Example 61 | $Fe_{77}P_{10}B_{10}Nb_2Cr_1$ | $Ti_0C_0Mn_0Cu_0$ | 0.28 |
| Example 62 | $Fe_{77}P_{10}B_{10}Nb_2Cr_1$ | $Ti_{0.1}C_{0.1}Mn_{0.1}Cu_{0.1}$ | 0.22 |
| Example 63 | $Fe_{77}P_{10}B_{10}Nb_2Cr_1$ | $Ti_{0.3}C_{0.1}Mn_{0.1}Cu_{0.1}$ | 0.18 |
| Example 64 | $Fe_{77}P_{10}B_{10}Nb_2Cr_1$ | $Ti_{0.5}C_{0.1}Mn_{0.1}Cu_{0.1}$ | 0.12 |
| Example 65 | $Fe_{77}P_{10}B_{10}Nb_2Cr_1$ | $Ti_{0.1}C_{0.1}Mn_{1.0}Cu_{0.1}$ | 0.20 |
| Example 66 | $Fe_{77}P_{10}B_{10}Nb_2Cr_1$ | $Ti_{0.1}C_{0.1}Mn_{2.0}Cu_{0.1}$ | 0.16 |
| Example 67 | $Fe_{77}P_{10}B_{10}Nb_2Cr_1$ | $Ti_{0.1}C_{0.1}Mn_{3.0}Cu_{0.1}$ | 0.15 |
| Example 68 | $Fe_{77}P_{10}B_{10}Nb_2Cr_1$ | $Ti_{0.1}C_{0.1}Mn_{0.1}Cu_{0.5}$ | 0.11 |
| Example 69 | $Fe_{77}P_{10}B_{10}Nb_2Cr_1$ | $Ti_{0.1}C_{0.1}Mn_{0.1}Cu_{1.0}$ | 0.06 |
| Example 70 | $Fe_{77}P_{10}B_{10}Nb_2Cr_1$ | $Ti_{0.1}C_{0.1}Mn_{0.1}Cu_{1.5}$ | 0.04 |
| Comparative Example 21 | METGLAS | | 2.7 |

Examples 71 to 73

Materials of Fe, Fe—P, Fe—B, Fe—Cr, Fe—Nb, Ti, C, Mn, and Cu were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons each having a thickness of 20 μm were produced using the single-roll method.

For comparison, a mother alloy having the same composition as that of commercialized METGLAS 2605-S2 was produced by high-frequency heating and then formed into a 20 μm ribbon by the single-roll method.

The 20 μm ribbons were each formed into a wound magnetic core with overlying portions thereof being bonded and insulated by a silicone resin interposed therebetween, then initial permeabilities were measured by an impedance analyzer. In this event, the respective samples were heat-treated in an Ar atmosphere at 350° C. for 60 minutes. On the other hand, the sample made of METGLAS 2605-S2 was heat-treated at 425° C. for 60 minutes.

TABLE 8

| | alloy composition at % | additive wt % | thickness μm | permeability of toroidal magnetic core 50 kHz |
|---|---|---|---|---|
| Example 71 | $Fe_{77}P_{10}B_{10}Nb_2Cr_1$ | $Ti_{0.1}C_{0.1}Mn_{0.1}Cu_{0.1}$ | 20 | 9800 |
| Example 72 | $Fe_{77}P_{10}B_{10}Nb_2Cr_1$ | $Ti_{0.1}C_{0.1}Mn_{0.1}Cu_{0.5}$ | 20 | 10000 |
| Example 73 | $Fe_{77}P_7B_{13}Nb_2Cr_1$ | $Ti_{0.1}C_{0.1}Mn_{0.1}Cu_{0.1}$ | 20 | 11300 |
| Comparative Example 22 | METGLAS | | 20 | 4000 |

As shown in Table 8, since the alloy compositions of Examples 71 to 73 fall within the composition range of this invention, they are excellent in soft magnetic properties. On the other hand, Comparative Example 22 is poor in soft magnetic properties.

Examples 74 to 78

Materials of Fe, Fe—P, Fe—B, Fe—Cr, Fe—Nb, Ti, C, Mn, and Cu were respectively weighed according to predetermined alloy compositions and then melted by high-frequency heating in a reduced-pressure Ar atmosphere in a chamber after evacuation, thereby producing mother alloys. Thereafter, by the use of the produced mother alloys, ribbons respectively having thicknesses of 20 to 170 μm were produced using the single-roll method by adjusting the revolution speed.

For comparison, a mother alloy having the same composition as that of commercialized METGLAS 2605-S2 was produced by high-frequency heating and then formed into a 20 μm ribbon by the single-roll method.

Pieces of each ribbon were laminated to form a laminated magnetic core having a width of 1 mm, a length of 16 mm, and a thickness of 1 mm. The ribbon pieces were bonded together and insulated from each other by a silicone resin interposed therebetween. After applying a 1200-turn coil to each of the laminated magnetic cores, Ls and Q were measured by an impedance analyzer. In this event, the respective samples were heat-treated in an Ar atmosphere at 350° C. for 60 minutes. On the other hand, the sample made of METGLAS 2605-S2 was heat-treated at 425° C. for 60 minutes. Results of the measurement of the samples are shown in Table 9.

TABLE 9

| | alloy composition at % | additive wt % | thickness μm | L of laminated magnetic core μH 50 kHz | Q of laminated magnetic core 50 kHz |
|---|---|---|---|---|---|
| Example 74 | $Fe_{77}P_{10}B_{10}Nb_2Cr_1$ | $Ti_{0.1}C_{0.1}Mn_{0.1}Cu_{0.1}$ | 20 | 42 | 52 |
| Example 75 | $Fe_{77}P_{10}B_{10}Nb_2Cr_1$ | $Ti_{0.1}C_{0.1}Mn_{0.1}Cu_{0.1}$ | 105 | 29 | 32 |
| Example 76 | $Fe_{77}P_{10}B_{10}Nb_2Cr_1$ | $Ti_{0.1}C_{0.1}Mn_{0.1}Cu_{0.1}$ | 150 | 28 | 28 |
| Comparative Example 23 | $Fe_{77}P_{10}B_{10}Nb_2Cr_1$ | $Ti_{0.1}C_{0.1}Mn_{0.1}Cu_{0.1}$ | 170 | 19 | 25 |
| Example 77 | $Fe_{77}P_{10}B_{10}Nb_2Cr_1$ | $Ti_{0.1}C_{0.3}Mn_{0.1}Cu_{0.1}$ | 20 | 41 | 49 |
| Example 78 | $Fe_{77}P_7B_{13}Nb_2Cr_1$ | $Ti_{0.1}C_{0.1}Mn_{0.1}Cu_{0.1}$ | 25 | 38 | 58 |
| Comparative Example 24 | METGLAS | | 20 | 20 | 26 |

As shown in Table 9, since the alloy compositions of Examples 74 to 78 fall within the composition range of this invention, they are excellent in soft magnetic properties at high frequencies. On the other hand, since Comparative Example 23 has a thickness exceeding 150 μm, the properties at high frequencies is poor due to eddy current loss. Further, Comparative Example 24 having the composition outside the composition range of this invention is poor in soft magnetic properties at high frequencies.

Examples 79 to 82

Materials of Fe, Fe—P, Fe—B, Fe—Cr, Fe—Nb, Ti, C, Mn, and Cu were respectively weighed according to predetermined alloy compositions and then melted by high-frequency heating in a reduced-pressure Ar atmosphere in a chamber after evacuation, thereby producing mother alloys. Thereafter, using the produced mother alloys, powders were produced by the water atomizing method.

For comparison, a mother alloy having the same composition as that of commercialized METGLAS 2605-S2 was produced by high-frequency heating and then formed into a powder by the water atomizing method.

The obtained powders were each classified into particle sizes of 200 μm or less and then measured by the use of the X-ray diffraction method, thereby obtaining X-ray diffraction profiles, and it was judged "amorphous phase" when the obtained X-ray diffraction profile showed only a broad peak, while it was judged "crystal phase" otherwise.

TABLE 10

| | alloy composition at % | additive wt % | powder −200 μm |
|---|---|---|---|
| Example 79 | $Fe_{77}P_7B_{13}Nb_2Cr_1$ | $Ti_{0.1}C_{0.1}Mn_{0.1}Cu_{0.1}$ | amorphous phase |
| Example 80 | $Fe_{77}P_9B_{11}Nb_2Cr_1$ | $Ti_{0.1}C_{0.1}Mn_{0.1}Cu_{0.1}$ | amorphous phase |
| Example 81 | $Fe_{77}P_{10}B_{10}Nb_2Cr_1$ | $Ti_{0.1}C_{0.1}Mn_{0.1}Cu_{0.1}$ | amorphous phase |
| Example 82 | $Fe_{77}P_{11}B_9Nb_2Cr_1$ | $Ti_{0.1}C_{0.1}Mn_{0.1}Cu_{0.1}$ | amorphous phase |

TABLE 10-continued

| | alloy composition at % | additive wt % | powder −200 μm |
|---|---|---|---|
| Comparative Example 25 | $Fe_{77}P_{10}B_{10}Nb_2Cr_1$ | $Ti_{0.1}C_{0.7}Mn_{0.1}Cu_{0.1}$ | crystal phase |
| Comparative Example 26 | METGLAS | | crystal phase |

As shown in Table 10, since the alloy compositions of Examples 79 to 82 fall within the composition range of this invention, it is possible to produce the amorphous soft magnetic powders by the water atomizing method. On the other hand, Comparative Examples 25 and 26 have no glass forming ability and thus the obtained powders are in the crystal phase. It was not possible to obtain amorphous soft magnetic powders.

Examples 83 to 86

Materials of Fe, Fe—P, Fe—B, Fe—Cr, Fe—Nb, Ti, C, Mn, and Cu were respectively weighed according to predetermined alloy compositions and then melted by high-frequency heating in a reduced-pressure Ar atmosphere in a chamber after evacuation, thereby producing mother alloys. Thereafter, using the produced mother alloys, amorphous soft magnetic powders were produced by the water atomizing method. The powders were each mixed with a 5 mass % silicone resin dissolved in a solvent so as to be granulated and then were each pressed under 980 MPa (10 ton/cm$^2$) into a dust core having an outer diameter of 18 mm, an inner diameter of 12 mm, and a thickness of 3 mm.

For comparison, an Fe powder, an Fe—Si—Cr powder, and a Sendust powder produced by water atomization were also each mixed with a 5 mass % silicone resin dissolved in a solvent so as to be granulated and then were each pressed under 980 MPa (10 ton/cm$^2$) into a dust core having an outer diameter of 18 mm, an inner diameter of 12 mm, and a thickness of 3 mm.

With respect to the obtained dust cores, initial permeabilities were measured by an impedance analyzer and Fe losses and densities were measured by an ac B—H analyzer. In this event, the respective samples were heat-treated in an Ar atmosphere at 350° C. for 60 minutes. On the other hand, the samples made of the Fe powder and the Fe—Si—Cr powder were heat-treated at 500° C. for 60 minutes, while the sample made of the Sendust powder was heat-treated at 700° C. for 60 minutes. The measured initial permeabilities, losses, and densities are shown in Table 11.

TABLE 11

| | alloy composition at % | additive wt % | initial permeability 50 kHz | loss mW/cc 50 kHz-300 mT | density % |
|---|---|---|---|---|---|
| Example 83 | $Fe_{77}P_7B_{13}Nb_2Cr_1$ | $Ti_{0.1}C_{0.1}Mn_{0.1}Cu_{0.1}$ | 26 | 760 | 74 |
| Example 84 | $Fe_{77}P_9B_{11}Nb_2Cr_1$ | $Ti_{0.1}C_{0.1}Mn_{0.1}Cu_{0.1}$ | 25 | 820 | 73 |
| Example 85 | $Fe_{77}P_{10}B_{10}Nb_2Cr_1$ | $Ti_{0.1}C_{0.1}Mn_{0.1}Cu_{0.1}$ | 26 | 860 | 73 |
| Example 86 | $Fe_{77}P_{11}B_9Nb_2Cr_1$ | $Ti_{0.1}C_{0.1}Mn_{0.1}Cu_{0.1}$ | 27 | 920 | 74 |
| Comparative Example 27 | Fe | | 18 | 6320 | 85 |
| Comparative Example 28 | Fe—Si—Cr | | 26 | 2850 | 82 |
| Comparative Example 29 | Sendust | | 24 | 2200 | 78 |

As shown in Table 11, it is understood that since the dust cores made of the amorphous soft magnetic powders of Examples 83 to 86 fall within the scope of this invention, losses thereof are very low. On the other hand, Comparative Example 27 is the dust core made of the Fe powder and, while the density is high, the initial permeability and loss at high frequencies are extremely bad. Also in Comparative Examples 28 and 29, the losses are very bad.

Examples 87 to 110

At first, as a powder production process, pure metal element materials of Fe, Co, Ni, P, B, Si, Mo, Al, V, Cr, Y, Zr, Nb, Ta, and W were respectively weighed according to predetermined alloy compositions, thereby producing mother alloys. Thereafter, by the use of the produced mother alloys, various soft magnetic alloy powders were produced by the water atomizing method.

Then, as a molded product production process, the obtained alloy powders were each classified into particle sizes of 45 μm or less and then mixed with a silicone resin as a binder in an amount of 4% by mass and, thereafter, using a molding die having a groove with an outer diameter of 27 mm and an inner diameter of 14 mm, were each applied with a pressure of 1.18 GPa (about 12 t/cm$^2$) at room temperature so as to have a height of 5 mm, thereby obtaining respective molded products.

Further, after resin curing of the obtained molded products, the weights and sizes of the molded products were measured and then coils each having a proper number of turns were applied to the molded products, i.e. the magnetic cores, respectively, thereby producing respective inductance components (each as shown in FIG. 2).

Then, with respect to each of the obtained samples, i.e. inductance components, the magnetic permeability was derived from an inductance value at 100 kHz using an LCR meter and, further, the saturation magnetic flux density, when a magnetic field of $1.6\times10^4$ A/m was applied, was measured using a dc magnetic property measuring apparatus. Further, upper and lower surfaces of each magnetic core were polished and then XRD (X-ray diffraction) measurement was performed to observe the phase. Results are shown in Table 12-1 and Table 12-2.

TABLE 12-1

| | alloy composition at % | magnetic flux density/T at 1.6 × $10^4$ A/m | initial permeability at 100 kHz | XRD measurement result |
|---|---|---|---|---|
| Comparative Example 30 | $Fe_{79}P_1B_{16}Mo_4$ | 0.64 | 25 | crystal phase |
| Example 87 | $Fe_{78}P_2B_{16}Mo_4$ | 0.63 | 30 | amorphous phase |
| Example 88 | $Fe_{75}P_{16}B_5Mo_4$ | 0.60 | 30 | amorphous phase |
| Comparative Example 31 | $Fe_{74}P_{17}B_5Mo_4$ | 0.59 | 24 | crystal phase |
| Comparative Example 32 | $Fe_{79}P_{16}B_1Mo_4$ | 0.63 | 20 | crystal phase |
| Example 89 | $Fe_{78}P_{16}B_2Mo_4$ | 0.62 | 32 | amorphous phase |
| Example 90 | $Fe_{75}P_5B_{16}Mo_4$ | 0.59 | 30 | amorphous phase |
| Comparative Example 33 | $Fe_{74}P_5B_{17}Mo_4$ | 0.58 | 25 | crystal phase |
| Comparative Example 34 | $Fe_{82}P_8B_{10}Mo_0$ | 0.79 | 24 | crystal phase |
| Example 91 | $Fe_{81}P_8B_{10}Mo_1$ | 0.75 | 30 | amorphous phase |
| Example 92 | $Fe_{78}P_8B_{10}Mo_4$ | 0.62 | 32 | amorphous phase |
| Example 93 | $Fe_{72}P_8B_{10}Mo_{10}$ | 0.37 | 30 | amorphous phase |
| Comparative Example 35 | $Fe_{71}P_8B_{10}Mo_{11}$ | 0.30 | 25 | crystal phase |
| Example 94 | $Fe_{78}P_7B_9Mo_4Si_2$ | 0.62 | 32 | amorphous phase |
| Example 95 | $Fe_{72}P_7B_9Mo_4Si_8$ | 0.55 | 30 | amorphous phase |
| Comparative Example 36 | $Fe_{71}P_7B_9Mo_4Si_9$ | 0.53 | 24 | crystal phase |
| Example 96 | $Fe_{72}P_8B_{10}Al_4$ | 0.75 | 30 | amorphous phase |
| Example 97 | $Fe_{78}P_8B_{10}V_4$ | 0.67 | 31 | amorphous phase |
| Example 98 | $Fe_{78}P_8B_{10}Cr_4$ | 0.64 | 30 | amorphous phase |
| Example 99 | $Fe_{78}P_8B_{10}Y_4$ | 0.63 | 30 | amorphous phase |
| Example 100 | $Fe_{78}P_8B_{10}Nr_4$ | 0.63 | 31 | amorphous phase |
| Example 101 | $Fe_{78}P_8B_{10}Nb_4$ | 0.62 | 32 | amorphous phase |
| Example 102 | $Fe_{78}P_8B_{10}Ta_4$ | 0.61 | 32 | amorphous phase |
| Example 103 | $Fe_{78}P_8B_{10}W_4$ | 0.60 | 31 | amorphous phase |

TABLE 12-2

| | alloy composition at % | magnetic flux density/T at 1.6 × $10^4$ A/m | initial permeability at 100 kHz | XRD measurement result |
|---|---|---|---|---|
| Example 104 | $(Fe_{0.8}Co_{0.2})_{78}P_8B_{10}Mo_4$ | 0.63 | 31 | amorphous phase |
| Example 105 | $(Fe_{0.8}Ni_{0.2})_{78}P_8B_{10}Mo_4$ | 0.59 | 32 | amorphous phase |
| Example 106 | $(Fe_{0.1}Co_{0.9})_{78}P_8B_{10}Mo_4$ | 0.22 | 34 | amorphous phase |
| Example 107 | $(Fe_{0.05}Ni_{0.05}Co_{0.9})_{78}P_8B_{10}Mo_4$ | 0.20 | 37 | amorphous phase |
| Comparative Example 37 | $(Fe_{0.0}Ni_{1.0})_{78}P_8B_{10}Mo_4$ | 0 | — | amorphous phase |
| Example 108 | $(Fe_{0.8}Co_{0.2})_{78}P_7B_9Si_2Mo_4$ | 0.63 | 30 | amorphous phase |
| Example 109 | $(Fe_{0.8}Ni_{0.2})_{78}P_7B_9Si_2Mo_4$ | 0.57 | 32 | amorphous phase |
| Example 110 | $(Fe_{0.05}Ni_{0.05}Co_{0.9})_{78}P_7B_9Si_2Mo_4$ | 0.20 | 37 | amorphous phase |
| Comparative Example 38 | $(Fe_{0.0}Ni_{1.0})_{78}P_7B_9Si_2Mo_4$ | 0 | — | amorphous phase |

In Table 12, the composition ratios of the respective samples are shown and it was judged "amorphous phase" when only a broad peak peculiar to the amorphous phase was detected in an XRD pattern obtained by the XRD measurement, while it was judged "crystal phase" when a sharp peak due to the crystal phase was observed along with a broad peak or when only a sharp peak was observed with no broad peak. With respect to those samples having the compositions that exhibited the amorphous phase, thermal analysis by DSC was performed to measure glass transition temperatures (Tg) and crystallization temperatures (Tx) and it was confirmed that ΔTx was 20° C. or more for all those samples. Resistivities of the respective molded products (magnetic cores) were measured by a dc two-terminal method and it was confirmed that all the samples showed good values of 1 Ω·cm or more.

The heating rate in DSC was set to 40 K/min. It is understood from Examples 87 to 89 and Comparative Examples 30 to 33 that the amorphous phase capable of obtaining a high permeability cannot be formed when the content of P or B is less than 2% or more than 16%, while the amorphous phase can be formed when the content of P and the content of B are both in a range of 2% or more and 16% or less. It is understood from Examples 90 to 92 and Comparative Examples 34 and 35 that the amorphous phase cannot be formed when the content of Mo is 0% or more than 10%, while the amorphous phase can be formed when the content of Mo is more than 0% and 10% or less. It is understood from Examples 93 and 94 and Comparative Example 36 that the amorphous phase can be formed even when Si is added in a range of 8% or less. It is understood from Examples 95 to 102 that the amorphous phase can be formed even when Mo is replaced by Al, V, Cr, Y, Zr, Nb, Ta, or W. It is understood from Examples 103 to 110 that Fe may be partly replaced by Co and/or Ni, but it is understood from Comparative Examples 37 and 38 that if Fe is totally replaced, although the amorphous phase is obtained, the magnetic flux density becomes zero, which is thus not suitable for the field of this invention.

Examples 111 to 132

At first, as a powder production process, pure metal element materials of Fe, Co, Ni, P, B, Si, Mo, Al, V, Cr, Y, Zr, Nb, Ta, W, Ti, C, Mn, and Cu were respectively weighed according to predetermined alloy compositions, thereby producing mother alloys. Thereafter, using the produced mother alloys, various soft magnetic alloy powders were produced by the water atomizing method.

Then, as a molded product production process, the obtained alloy powders were each classified into particle sizes of 45 μm or less and then mixed with a silicone resin as a binder in an amount of 4% by mass and, thereafter, using a molding die having a groove with an outer diameter of 27 mm and an inner diameter of 14 mm, were each applied with a pressure of 1.18 GPa (about 12 t/cm$^2$) at room temperature so as to have a height of 5 mm, thereby obtaining respective molded products.

Further, after resin curing of the obtained molded products, the weights and sizes of the molded products were measured and then coils each having a proper number of turns were applied to the molded products, i.e. the magnetic cores, respectively, thereby producing respective inductance components (each as shown in FIG. 2).

Then, with respect to each of the obtained samples, i.e. inductance components, the magnetic permeability was derived from an inductance value at 100 kHz using an LCR meter and, further, the saturation magnetic flux density, when a magnetic field of 1.6×$10^4$ A/m was applied, was measured using a dc magnetic property measuring apparatus. Further, upper and lower surfaces of each magnetic core were polished and then XRD (X-ray diffraction) measurement was performed to observe the phase. Results are shown in Table 13-1 and Table 13-2.

In Table 13-1 and Table 13-2, the composition ratios of the respective samples are shown and it was judged "amorphous phase" when only a broad peak peculiar to the amorphous phase was detected in an XRD pattern obtained by the XRD measurement, while it was judged "crystal phase" when a sharp peak due to the crystal phase was observed along with a broad peak or when only a sharp peak was observed with no broad peak. With respect to those samples having the compositions that exhibited the amorphous phase, thermal analysis by DSC was performed to measure glass transition temperatures (Tg) and crystallization temperatures (Tx) and it was confirmed that ΔTx was 20° C. or more for all those samples. Resistivities of the respective molded products (magnetic cores) were measured by a dc two-terminal method and it was confirmed that all the samples showed good values of 1 Ω·cm or more.

As shown in Table 13-1 and Table 13-2, since the alloy compositions of Examples 111 to 132 fall within the composition range of this invention, they respectively have

TABLE 13-1

| | alloy composition at % | additive wt % | magnetic flux density/T at 1.6 × $10^4$ A/m | initial permeability at 100 kHz | XRD measurement result |
|---|---|---|---|---|---|
| Example 111 | $Fe_{77}P_{10}B_{10}Nb_2Cr_1$ | $Ti_0C_0Mn_0Cu_0$ | 0.49 | 32 | amorphous phase |
| Example 112 | $Fe_{77}P_{10}B_{10}Nb_2Cr_1$ | $Ti_{0.1}C_{0.1}Mn_{0.1}Cu_{0.1}$ | 0.49 | 32 | amorphous phase |
| Comparative Example 39 | $Fe_{81}P_1B_{15}Nb_2Cr_1$ | $Ti_{0.1}C_{0.1}Mn_{0.1}Cu_{0.1}$ | 0.50 | 20 | crystal phase |
| Example 113 | $Fe_{80}P_2B_{15}Nb_2Cr_1$ | $Ti_{0.1}C_{0.1}Mn_{0.1}Cu_{0.1}$ | 0.50 | 30 | amorphous phase |
| Example 114 | $Fe_{75}P_{18}B_4Nb_2Cr_1$ | $Ti_{0.1}C_{0.1}Mn_{0.1}Cu_{0.1}$ | 0.48 | 30 | amorphous phase |
| Comparative Example 40 | $Fe_{74}P_{19}B_4Nb_2Cr_1$ | $Ti_{0.1}C_{0.1}Mn_{0.1}Cu_{0.1}$ | 0.47 | 24 | crystal phase |
| Comparative Example 41 | $Fe_{81}P_{16}B_1Nb_2Cr_1$ | $Ti_{0.1}C_{0.1}Mn_{0.1}Cu_{0.1}$ | 0.50 | 20 | crystal phase |
| Example 115 | $Fe_{80}P_{15}B_2Nb_2Cr_1$ | $Ti_{0.1}C_{0.1}Mn_{0.1}Cu_{0.1}$ | 0.50 | 30 | amorphous phase |
| Example 116 | $Fe_{75}P_4B_{18}Nb_2Cr_1$ | $Ti_{0.1}C_{0.1}Mn_{0.1}Cu_{0.1}$ | 0.47 | 32 | amorphous phase |
| Comparative Example 42 | $Fe_{74}P_4B_{19}Nb_2Cr_1$ | $Ti_{0.1}C_{0.1}Mn_{0.1}Cu_{0.1}$ | 0.47 | 22 | crystal phase |
| Comparative Example 43 | $Fe_{79.5}P_{10}B_{10}Nb_{0.5}Cr_0$ | $Ti_{0.1}C_{0.1}Mn_{0.1}Cu_{0.1}$ | 0.57 | 20 | crystal phase |
| Example 117 | $Fe_{79}P_{10}B_{10}Nb_1Cr_0$ | $Ti_{0.1}C_{0.1}Mn_{0.1}Cu_{0.1}$ | 0.55 | 30 | amorphous phase |
| Example 118 | $Fe_{78}P_{10}B_{10}Nb_2Cr_0$ | $Ti_{0.1}C_{0.1}Mn_{0.1}Cu_{0.1}$ | 0.53 | 32 | amorphous phase |
| Example 119 | $Fe_{75}P_{10}B_{10}Nb_4Cr_1$ | $Ti_{0.1}C_{0.1}Mn_{0.1}Cu_{0.1}$ | 0.45 | 32 | amorphous phase |
| Example 120 | $Fe_{74}P_{10}B_{10}Nb_5Cr_1$ | $Ti_{0.1}C_{0.1}Mn_{0.1}Cu_{0.1}$ | 0.42 | 31 | amorphous phase |
| Comparative Example 44 | $Fe_{73}P_{10}B_{10}Nb_5Cr_1$ | $Ti_{0.1}C_{0.1}Mn_{0.1}Cu_{0.1}$ | 0.38 | 24 | crystal phase |
| Example 121 | $Fe_{73}P_{10}B_{10}Si_4Nb_2Cr_1$ | $Ti_{0.1}C_{0.1}Mn_{0.1}Cu_{0.1}$ | 0.47 | 30 | amorphous phase |
| Comparative Example 45 | $Fe_{72}P_{10}B_{10}Si_5Nb_2Cr_1$ | $Ti_{0.1}C_{0.1}Mn_{0.1}Cu_{0.1}$ | 0.46 | 24 | crystal phase |
| Comparative Example 46 | $Fe_{83}P_7B_7Nb_2Cr_1$ | $Ti_{0.1}C_{0.1}Mn_{0.1}Cu_{0.1}$ | 0.50 | 19 | crystal phase |

TABLE 13-2

| | alloy composition at % | additive wt % | magnetic flux density/T at 1.6 × $10^4$ A/m | initial permeability at 100 kHz | XRD measurement result |
|---|---|---|---|---|---|
| Example 122 | $Fe_{82}P_{7.5}B_{7.5}Nb_2Cr_1$ | $Ti_{0.1}C_{0.1}Mn_{0.1}Cu_{0.1}$ | 0.50 | 30 | amorphous phase |
| Example 123 | $Fe_{74}P_{11.5}B_{11.5}Nb_2Cr_1$ | $Ti_{0.1}C_{0.1}Mn_{0.1}Cu_{0.1}$ | 0.48 | 31 | amorphous phase |
| Comparative Example 47 | $Fe_{73}P_{12}B_{12}Nb_2Cr_1$ | $Ti_{0.1}C_{0.1}Mn_{0.1}Cu_{0.1}$ | 0.46 | 24 | crystal phase |
| Example 124 | $Fe_{73}P_{10}B_{10}Nb_2Cr_1$ | $Ti_{0.3}C_{0.1}Mn_{0.1}Cu_{0.1}$ | 0.48 | 30 | amorphous phase |
| Comparative Example 48 | $Fe_{77}P_{10}B_{10}Nb_2Cr_1$ | $Ti_{0.4}C_{0.1}Mn_{0.1}Cu_{0.1}$ | 0.48 | 24 | crystal phase |
| Example 125 | $Fe_{77}P_{10}B_{10}Nb_2Cr_1$ | $Ti_{0.1}C_{0.3}Mn_{0.1}Cu_{0.1}$ | 0.50 | 31 | amorphous phase |
| Example 126 | $Fe_{77}P_{10}B_{10}Nb_2Cr_1$ | $Ti_{0.1}C_{0.5}Mn_{0.1}Cu_{0.1}$ | 0.50 | 30 | amorphous phase |
| Comparative Example 49 | $Fe_{77}P_{10}B_{10}Nb_2Cr_1$ | $Ti_{0.1}C_{0.6}Mn_{0.1}Cu_{0.1}$ | 0.51 | 24 | crystal phase |
| Example 127 | $Fe_{77}P_{10}B_{10}Nb_2Cr_1$ | $Ti_{0.1}C_{0.1}Mn_{1.0}Cu_{0.1}$ | 0.47 | 31 | amorphous phase |
| Example 128 | $Fe_{77}P_{10}B_{10}Nb_2Cr_1$ | $Ti_{0.1}C_{0.1}Mn_{2.0}Cu_{0.1}$ | 0.45 | 32 | amorphous phase |
| Comparative Example 50 | $Fe_{77}P_{10}B_{10}Nb_2Cr_1$ | $Ti_{0.1}C_{0.1}Mn_{3.0}Cu_{0.1}$ | 0.42 | 24 | crystal phase |
| Example 129 | $Fe_{77}P_{10}B_{10}Nb_2Cr_1$ | $Ti_{0.1}C_{0.1}Mn_{0.1}Cu_{0.5}$ | 0.49 | 31 | amorphous phase |
| Example 130 | $Fe_{77}P_{10}B_{10}Nb_2Cr_1$ | $Ti_{0.1}C_{0.1}Mn_{0.1}Cu_{1.0}$ | 0.48 | 30 | amorphous phase |
| Comparative Example 51 | $Fe_{77}P_{10}B_{10}Nb_2Cr_1$ | $Ti_{0.1}C_{0.1}Mn_{0.1}Cu_{1.2}$ | 0.48 | 24 | crystal phase |
| Example 131 | $(Fe_{0.7}Co_{0.3})_{77}P_{10}B_{10}Nb_2Cr_1$ | $Ti_{0.1}C_{0.1}Mn_{0.1}Cu_{0.1}$ | 0.50 | 32 | amorphous phase |
| Comparative Example 52 | $(Fe_{0.6}Co_{0.4})_{77}P_{10}B_{10}Nb_2Cr_1$ | $Ti_{0.1}C_{0.1}Mn_{0.1}Cu_{0.1}$ | 0.50 | 23 | crystal phase |
| Example 132 | $(Fe_{0.7}Ni_{0.3})_{77}P_{10}B_{10}Nb_2Cr_1$ | $Ti_{0.1}C_{0.1}Mn_{0.1}Cu_{0.1}$ | 0.45 | 31 | amorphous phase |
| Comparative Example 53 | $(Fe_{0.6}Ni_{0.4})_{77}P_{10}B_{10}Nb_2Cr_1$ | $Ti_{0.1}C_{0.1}Mn_{0.1}Cu_{0.1}$ | 0.42 | 24 | crystal phase |

supercooled liquid regions and are excellent in amorphous-forming ability and soft magnetic properties. On the other hand, it is understood that Comparative Examples 39 to 53 are poor in amorphous-forming ability and thus can obtain only the crystal phase and cannot obtain good permeability properties.

Example 133

In Example 133, an alloy powder having a composition of $Fe_{77}P_{10}B_{10}Nb_2Cr_1Ti_{0.1}C_{0.1}Mn_{0.1}Cu_{0.1}$ was produced by the water atomizing method, then the obtained powder was classified into particle sizes of 45 μm or less and then was subjected to XRD measurement, thereby confirming a broad peak peculiar to the amorphous phase. Further, thermal analysis by DSC was performed to measure a glass transition temperature (Tg) and a crystallization temperature (Tx), thereby confirming that ΔTx (Tg−Tx) was 36° C. Then, the powder was held at a temperature of 400° C., which was lower than the glass transition temperature, so as to be heat-treated in the atmosphere for 0.5 hours, thereby forming an oxide on the surfaces of the powder.

Further, the powder formed with the oxide was added with a silicone resin as a binder in amounts of 5%, 2.5%, 1%, and 0.5%, respectively, to obtain respective powders. By the use of a molding die having a groove with an outer diameter of 27 mm and an inner diameter of 14 mm, the obtained powders were each applied with a pressure of 1.18 GPa (12 ton/cm$^2$) at room temperature, at 150° C. higher than a softening temperature of the resin, or at 480° C. being a supercooled liquid region of the amorphous soft magnetic metal powder so as to have a height of 5 mm, thereby obtaining respective molded products.

After resin curing of the obtained molded products, the weights and sizes of the molded products were measured and then coils each having a proper number of turns were applied to the molded products, i.e. the magnetic cores, respectively, thereby producing respective inductance components (each as shown in FIG. 2).

Then, with respect to each of the obtained inductance components of sample Nos. 1 to 12, a powder filling ratio (%), a magnetic flux density (at 1.6×10$^4$ A/m) caused by dc magnetic properties, and a dc resistivity (Ω·cm) were measured. Results are shown in Table 14.

TABLE 14

| Sample No. | Resin Amount | Molding Temperature | powder filling ratio % | magnetic flux density/T at 1.6 × 10$^4$ A/m | resistivity Ωcm |
|---|---|---|---|---|---|
| 1 | 0.5% | room temperature | 68.1 | 0.44 | ≥100 |
| 2 | 1.0% | room temperature | 69.9 | 0.45 | ≥100 |
| 3 | 2.5% | room temperature | 72.7 | 0.47 | ≥100 |
| 4 | 5.0% | room temperature | 71.5 | 0.46 | ≥100 |
| 5 | 0.5% | 150° C. | 80.3 | 0.73 | 5 |
| 6 | 1.0% | 150° C. | 81.9 | 0.75 | 10 |
| 7 | 2.5% | 150° C. | 82.6 | 0.75 | 15 |
| 8 | 5.0% | 150° C. | 72.7 | 0.47 | ≥100 |
| 9 | 0.5% | 480° C. | 95.2 | 1.13 | 0.1 |
| 10 | 1.0% | 480° C. | 92.4 | 1.09 | 0.5 |
| 11 | 2.5% | 480° C. | 83.0 | 0.76 | 10 |
| 12 | 5.0% | 480° C. | 73.4 | 0.48 | ≥100 |

From Table 14, it is understood that when the addition amount of the binder (resin amount) exceeds 5%, a high resistivity value of ≥10E4 (=10$^5$) comparable to a ferrite magnetic core is obtained, while such an effect is not observed even by raising the molding temperature and the molding condition like the room temperature is sufficient. It is understood that a high resistivity of 1 Ω·cm or more is obtained also when the resin amount is 5%, but the molding at room temperature is sufficient likewise. Further, it is understood that, in the case of the resin amount being 2.5%, when the molding is carried out at 150° C., the powder filling ratio is significantly improved to increase the magnetic flux density and further a resistivity of 0.1 Ω·cm or more is obtained. In addition, it is understood that, in the case of the resin amount being 1% or 0.5%, when the molding is carried out at 480° C., the powder filling ratio is significantly improved to increase the saturation magnetic flux density and further a resistivity of 0.01 Ω·cm or more is obtained.

Example 134

In Example 134, an inductance component corresponding to sample No. 10 in Example 133 was produced, an inductance component was produced using a high-frequency magnetic core produced by the same alloy powder and the same manufacturing process and heat-treated in a nitrogen atmosphere at 450° C. for 0.5 hours. Further, for comparison, inductance components were produced using Sendust, a 6.5% silicon steel, and an Fe-based amorphous material as magnetic core materials. The inductance components are each as shown in FIG. 2, but may also be one having a gap at a portion of a magnetic path as shown in FIG. 4. With respect to each of these inductance components, a magnetic flux density (at 1.6×10$^4$ A/m) caused by dc magnetic properties, a dc resistivity (Ω·cm), a permeability for inductance value normalization, and a core loss (20 kHz 0.1 T) were measured. Results are shown in Table 15.

TABLE 15

| Sample Name | magnetic flux density/T at 1.6 × 10$^4$ A/m | resistivity Ωcm | permeability — | core loss 20 kHz 0.1 T |
|---|---|---|---|---|
| present invention | 10,900 | 0.5 | 150 | 60 mW/cc |
| present invention (heat-treated) | 11,100 | 0.5 | 200 | 20 |
| MnZn ferrite | 5,500 | ≥10E4 | 100* | 8 |
| Sendust | 6,500 | 100 | 80 | 90 |
| 6.5% silicon steel | 10,000 | 100μ | 100* | 250 |
| Fe-based amorphous | 13,000 | 150μ | 100* | 400 |

*Because of a power supply specification in which a gap is formed at a portion of a magnetic path.

From Table 15, it is understood that the inductance component of this invention has a magnetic flux density substantially equivalent to that of the inductance component using the Fe-based amorphous magnetic core, while exhibits a core loss lower than that of the inductance component using the Sendust magnetic core, thus possessing very excellent properties. Further, it is understood that the magnetic permeability and the core loss are improved in the inductance component having the heat-treated magnetic core, thus possessing more excellent properties.

Example 135

In Example 135, water-atomized powders having alloy compositions shown in Table 16 and each screened to particle sizes of 20 μm or less through a standard sieve were added to a powder identical to that produced in Example 133, in ratios shown in Table 16, respectively, thereby obtaining respective powders.

Further, the obtained powders were each added with a silicone resin as a binder in an amount of 1.5% by mass and, thereafter, using a molding die having a groove with an outer diameter of 27 mm and an inner diameter of 14 mm, were each applied with a pressure of 1.18 GPa (12 ton/cm$^2$) at room temperature so as to have a height of 5 mm, thereby obtaining respective molded products. After the molding, the molded products were heat-treated in an Ar atmosphere at 450° C.

Then, after resin curing of the obtained molded products, the weights and sizes of the molded products were measured and then coils each having a proper number of turns were applied to the molded products, i.e. the magnetic cores, respectively, thereby producing respective inductance components (each as shown in FIG. 2).

Then, with respect to each of the obtained samples, i.e. inductance components, a powder filling ratio (%), a magnetic permeability, and a core loss (20 kHz 0.1 T) were measured. Results are shown in Table 16.

TABLE 16

| Sample No. | alloy composition | added power ratio % | powder filling ratio | permeability at 100 kHZ | core loss 20 kHz 0.1 T |
|---|---|---|---|---|---|
| comparative example 54 | — | — | 74.5 | 34 | 20 kW/m$^3$ |
| 1 | 3% SiFe | 5 | 75.1 | 37 | 25 |
| 2 | 3% SiFe | 10 | 75.7 | 39 | 35 |
| 3 | 3% SiFe | 20 | 76.3 | 40 | 55 |
| 4 | 3% SiFe | 30 | 76.9 | 41 | 65 |
| 5 | 3% SiFe | 40 | 77.5 | 42 | 75 |
| 6 | 3% SiFe | 50 | 78.0 | 44 | 85 |
| 7 | 3% SiFe | 60 | 78.2 | 44 | 190 |
| 8 | Sendust | 30 | 75.7 | 38 | 75 |
| 9 | Mo Permalloy | 30 | 78.0 | 43 | 80 |
| 10 | pure iron powder | 30 | 79.5 | 48 | 90 |

From Table 16, it is understood that the inductance component of this invention is improved in powder filling ratio by adding, to the amorphous metal powder, the soft magnetic powder having smaller particle sizes and the magnetic permeability is improved accordingly. On the other hand, it is understood that since the improving effect is weakened and the core loss characteristics are extremely deteriorated when the addition amount exceeds 50%, the addition amount is preferably 50% or less.

Example 136

In Example 136, alloy powders having a composition of $Fe_{77}P_{10}B_{10}Nb_2Cr_1Ti_{0.1}C_{0.1}Mn_{0.1}Cu_{0.1}$ were produced so as to have aspect ratios shown in Table 17 by changing the manufacturing conditions of the water atomizing method, then the obtained powders were each classified into particle sizes of 45 μm or less and then were each subjected to XRD measurement, thereby confirming a broad peak peculiar to the amorphous phase. Further, thermal analysis by DSC was applied to each of the powders to measure a glass transition temperature and a crystallization temperature, thereby confirming that a supercooled temperature range ΔTx was 20° C.

Further, the obtained powders were each added with a silicone resin as a binder in an amount of 3.0% by mass and, thereafter, by the use of a molding die having a groove with an outer diameter of 27 mm and an inner diameter of 14 mm, were each applied with a pressure of 1.47 GPa (15 ton/cm$^2$) at room temperature so as to have a height of 5 mm, thereby obtaining respective molded products. After the molding, the molded products were heat-treated in an Ar atmosphere at 450° C.

Then, after resin curing of the obtained molded products, the weights and sizes of the molded products were measured and then coils each having a proper number of turns were applied to the molded products, i.e. the magnetic cores, respectively, thereby producing respective inductance components (each as shown in FIG. 2).

Then, with respect to each of the obtained samples, i.e. inductance components, a powder filling ratio (%) and a magnetic permeability were measured. Results are shown in Table 17.

TABLE 17

| aspect ratio | powder filling ratio % | permeability at 100 kHz at 0 (Oe) | permeability at 100 kHz at 50 (Oe) |
|---|---|---|---|
| 1.1 | 73 | 32 | 30 |
| 1.3 | 71 | 35 | 30 |
| 1.5 | 70 | 37 | 31 |
| 1.9 | 69 | 42 | 31 |
| 2.2 | 68 | 47 | 29 |

From Table 17, it is understood that the inductance component of this invention is improved in magnetic permeability by increasing the aspect ratio of the amorphous metal powder. On the other hand, it is understood that since the initial permeability is high but the magnetic permeability in dc superimposition is deteriorated when the aspect ration exceeds 2.0, the aspect ratio of the powder is preferably 2 or less.

Example 137

At first, as a powder production process, materials were weighed to obtain a composition of $Fe_{77}P_{10}B_{10}Nb_2Cr_1Ti_{0.1}C_{0.1}Mn_{0.1}Cu_{0.1}$ and, using this, a fine soft magnetic alloy powder having different center particle sizes was produced by a high-pressure water atomizing method.

Then, as a molded product production process, powders shown in Table 18 were produced by screening the obtained alloy powder through various standard sieves, then were each mixed with a silicone resin as a binder in an amount of 3% by mass, then were each placed in a 10 mm×10 mm molding die along with a 3.5-turn coil having an outer diameter of 8 mm, an inner diameter of 4 mm, and a height of 2 mm and disposed so as to be located at the center of a molded product after the molding, and then were each applied with a pressure of 490 MPa (5 ton/cm$^2$) at room temperature so as to have a height of 4 mm, thereby obtaining respective molded products. Then, resin curing of the obtained molded products was carried out at 150° C. With respect to the conditions of sample No. 5, there was also produced a sample obtained by heat-treating the molded product in a nitrogen atmosphere at 450° C. for 0.5 hours.

Then, with respect to each of the obtained samples, i.e. inductance components, an inductance value at 1 MHz and a peak frequency and a peak value of Q were derived from inductance and resistance measurement at respective frequencies using an LCR meter. Results are shown in Table 18.

Then, with respect to each of the sample inductance components, the power supply conversion efficiency was measured using a general dc-dc converter evaluation kit. The measurement conditions were such that an input was 12V, an output 5V, a driving frequency 300 kHz, and an output current 1A. Results are also shown in Table 18.

TABLE 18

| Sample No. | sieve particle size μm | center particle size (D50) μm | L (μH) at 1 MHz | peak frequency of Q | peak value of Q | power supply conversion efficiency |
|---|---|---|---|---|---|---|
| comparative example 55 | 45 | 34 | 0.60 | 300 kHz | 31 | 79.8% |
| 1 | 45 | 29 | 0.63 | 600 kHz | 43 | 83.3 |
| 2 | 45 | 24 | 0.66 | 800 kHz | 46 | 83.9 |
| 3 | 45 | 19 | 0.69 | 1.5 MHz | 61 | 85.5 |
| 4 | 45 | 16 | 0.67 | 2.5 MHz | 66 | 85.6 |
| 5 | 45 | 12 | 0.65 | 3.5 MHz | 75 | 85.9 |
| 5 (heat-treated) | 45 | 12 | 0.75 | 3.0 MHz | 81 | 87.6 |
| Comparative Example 56 | 63 | 28 | 0.69 | 400 kHz | 33 | 79.5 |

As seen from Table 18, the inductance component of this invention achieves a peak frequency of Q being 500 kHz or more and a peak value of Q being 40 or more by setting the sieve particle size to 45 μm or less and the center particle size to 30 μm or less, and simultaneously achieves a power supply conversion efficiency of 80% or more, which is excellent. Further, by setting the sieve particle size to 45 μm or less and the center particle size to 20 μm or less, a peak frequency of Q being 1 MHz or more are obtained and a peak value of Q being 50 or more and, in this event, a power supply conversion efficiency of 85% or more is obtained, which is more excellent. It is understood that the conversion efficiency is further improved by heat-treating the inductance component.

Example 138

At first, as a powder production process, materials were weighed to obtain a composition of $Fe_{77}P_{10}B_{10}Nb_2Cr_1Ti_{0.1}Mn_{0.1}Cu_{0.1}$ and, using this, a fine soft magnetic alloy powder was produced by the high-pressure water atomizing method.

Then, as a molded product production process, powders shown in Table 19 were produced by screening the obtained alloy powder through various standard sieves, then were each mixed with a silicone resin as a binder in an amount of 3% by mass, and then were each applied with a pressure of 490 MPa (5 ton/cm$^2$) so as to be formed into a toroidal shape having an outer diameter of 32 mm, an inner diameter of 20 mm, and a height of 5 mm, thereby obtaining respective molded products. The obtained molded products were subjected to resin curing at 150° C. For comparison, a sample using an Fe-6.5 mass % Si powder was produced in the same manner.

Then, a copper wire having a diameter of 0.1 mm and applied with amide-imide coating was wound by ten turns around each of the produced samples, thereby obtaining inductance components.

Then, with respect to each of the obtained inductance components, an inductance value at 10 kHz and a peak frequency and a peak value of Q were derived from inductance and resistance measurement at respective frequencies using an LCR meter. Results are shown in Table 19.

Then, with respect to each of these inductance components, the power supply conversion efficiency was measured using a general dc-dc converter evaluation kit. The measurement conditions were such that an input was 12V, an output 5V, a driving frequency 10 kHz, and an output current 1A. Results are also shown in Table 19.

Examples 139 and 140

Materials of Fe, Fe—P, Fe—B, Fe—Cr, Fe—Nb, Ti, C, Mn, and Cu were respectively weighed according to predetermined alloy compositions and then melted by high-frequency heating in a reduced-pressure Ar atmosphere in a

TABLE 19

| Sample No. | powder composition | sieve particle size μm | center particle size (D50) μm | L (μH) at 10 kHz | peak frequency of Q (kHz) | peak value of Q | power supply conversion efficiency (%) |
|---|---|---|---|---|---|---|---|
| 1 | $Fe_{77}P_{10}B_{10}Nb_2Cr_1Ti_{0.1}Mn_{0.1}Cu_{0.1}$ | 250 | 192 | 1.63 | 50 | 20 | 85.2 |
| 2 | $Fe_{77}P_{10}B_{10}Nb_2Cr_1Ti_{0.1}Mn_{0.1}Cu_{0.1}$ | 150 | 96 | 1.58 | 100 | 26 | 85.4 |
| 3 | $Fe_{77}P_{10}B_{10}Nb_2Cr_1Ti_{0.1}Mn_{0.1}Cu_{0.1}$ | 45 | 28 | 1.14 | 600 | 43 | 82.8 |
| comparative example 57 | Fe-6.5 wt % Si | 150 | 92 | 1.72 | 100 | 18 | 82.1 |

chamber after evacuation, thereby producing mother alloys. Thereafter, by the use of the produced mother alloys, ribbons each having a thickness of 20 μm were produced using the single-roll method.

TABLE 20

| | alloy | | | initial permeability at 1 kHz when heat-treated at respective temperatures | | | | | | |
|---|---|---|---|---|---|---|---|---|---|---|
| | composition at % | additive wt % | Tc ° C. | room temperature | 250° C. | 300° C. | 400° C. | 450° C. | 500° C. | 550° C. |
| Example 139 | $Fe_{77}P_{10}B_{10}Nb_2Cr_1$ | $Ti_0C_0Mn_0Cu_0$ | 280 | 700 | 1000 | 9000 | 11000 | 12000 | 8000 | 120 |
| Example 140 | $Fe_{77}P_{10}B_{10}Nb_2Cr_1$ | $Ti_{0.1}C_{0.1}Mn_{0.1}Cu_{0.1}$ | 278 | 600 | 800 | 8000 | 9500 | 10000 | 6000 | 80 |

The 20 μm ribbons were each formed into a wound magnetic core with overlying portions thereof being bonded and insulated by a silicone resin interposed therebetween, then initial permeabilities at 1 kHz were measured by an impedance analyzer. In this event, the respective samples were heat-treated in an Ar atmosphere at room temperature, at 250° C., at 300° C., at 400° C., at 450° C., 500° C., and 550° C. for 5 minutes, respectively.

As shown in Table 20, the alloy compositions of Examples 139 and 140 of this invention each exhibit excellent soft magnetic properties when heat-treated in a temperature range of a Curie temperature or higher and a crystallization temperature or less. Particularly, the soft magnetic properties are rapidly deteriorated at the crystallization temperature or higher.

INDUSTRIAL APPLICABILITY

As described above, a high-frequency magnetic core of this invention is obtained at a low cost using an amorphous soft magnetic metal material with a high saturation magnetic flux density and a high resistivity. Further, an inductance component formed by applying a coil to this high-frequency magnetic core is excellent in magnetic properties in a high-frequency band, which was not conventionally present. Accordingly, it is possible to produce a high-performance, high-permeability dust core at a low cost, which was not conventionally present. The high-frequency magnetic core of this invention is suitable for application to power supply components, such as choke coils and transformers, of various electronic devices.

Further, a high-frequency magnetic core of this invention made of a fine particle size powder enables production of a high-performance inductance component for higher frequencies. The high-frequency magnetic core made of the fine particle size powder further enables production of an inductance component which is small in size but is adapted for large current, by integrating together the magnetic body and a wound coil by pressure molding in the state where the wound coil is enclosed in the magnetic body. Accordingly, the high-frequency magnetic core of this invention is applicable to inductance components of choke coils, transformers, and so on.

What is claimed is:

1. A dust core comprising a molded mixture of a material powder comprising an amorphous soft magnetic alloy powder and a binder added thereto, wherein the amorphous soft magnetic alloy powder has a particle size of 200 μm or less (excluding zero), wherein a mixing ratio of the binder in the mixture is 5% or less by mass, a space factor of the material powder in the core is 70% or more, a magnetic flux density is 0.4 T or more in applying a magnetic field of $1.6\times10^4$ A/m, and a resistivity is 1 Ω·cm or more, and wherein the amorphous soft magnetic allow powder is made of an amorphous soft magnetic alloy comprising a composition expressed by a formula of $(Fe_{1-\alpha}TM_\alpha)_{100-w-x-y-z}P_wB_xL_ySi_zTi_pC_qMn_rCu_s$, wherein unavoidable impurities are contained, wherein:

TM is at least one element selected from the group consisting of Co and Ni,

L is at least one element selected from the group consisting of Al, Cr, Zr, Mo, and Nb, $0\leq\alpha\leq0.3$, $2\leq w\leq11.5$ at %, $2\leq x\leq18$ at %, $15\leq w+\leq23$ at %, $1<y\leq5$ at %, $0\leq z\leq4$ at %, p, q, r, and s each represents an addition ratio given that the total mass of Fe, TM, P, B, L and Si is 100, and are defined as $0<p\leq0.3$, $0<q\leq0.5$, $0<r\leq2$, and $0<s\leq1$, the composition fulfills one of the following conditions (A) and (B):

(A) L is at least one element selected from the group consisting of Cr, Zr, Mo and Nb; and (B) L is a combination of Al and at least one element selected from the group consisting of Cr, Zr, Mo and Nb, wherein $0<Al\leq5$ at %, $1\leq Cr\leq4$ at %, $0<Zr\leq5$ at %, $2\leq Mo\leq5$ at %, and $2\leq Nb\leq5$ at %, the alloy has a crystallization start temperature (Tx) which is 550° C. or less, a glass transition temperature (Tg) which is 520° C. or less, and a supercooled liquid region represented by $\Delta Tx=Tx-Tg$, which is 20° C. or more, and the alloy has a Curie temperature which is 240° C. or more.

2. The dust core according to claim 1, wherein p, q, r, and s satisfy $0.1\leq p\leq0.3$, $0.1\leq q\leq0.5$, $0.1\leq r\leq2$, and $0.1\leq s\leq1$.

3. The dust core according to claim 1, wherein the alloy has a saturation magnetic flux density which is 1.2 T or more.

4. The dust core according to claim 1, wherein the amorphous soft magnetic alloy powder contains at least one of an amorphous soft magnetic alloy powder produced by water atomization and an amorphous soft magnetic alloy powder produced by gas atomization, and 50% or more in number of particles of the powder have a particle size greater than 3 μm.

5. The dust core according to claim 1, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 250 μm, and has a particle size with a center diameter of 192 μm or less.

6. The dust core according to claim 1, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 150 μm, and has a particle size with a center diameter of 96 μm or less.

7. The dust core according to claim 1, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 45 μm, and has a particle size with a center diameter of 30 μm or less.

8. The dust core according to claim 1, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 45 μm, and has a particle size with a center diameter of 20 μm or less.

9. The dust core according to claim 1, wherein the amorphous soft magnetic alloy powder has an aspect ratio of about 1 to 2.

10. The dust core according to claim 1, wherein the material powder contains a soft magnetic alloy powder in an amount of 5 to 50% by volume, the soft magnetic alloy powder having a smaller center particle size and a lower hardness than the amorphous soft magnetic alloy powder.

11. An inductance component formed by integrally molding the dust core according to claim 1 and a coil, wherein the coil is formed by winding a linear conductor by at least one turn and is disposed in the core.

12. An inductance component formed by applying a coil with at least one turn to a magnetic core which is the dust core according to claim 1, wherein a peak value of Q (1/tan δ) of the inductance component in a frequency band of 10 kHz or more is 20 or more.

13. An inductance component formed by applying a coil with at least one turn to a magnetic core which is the dust core according to claim 1, wherein a peak value of Q (1/tan δ) of the inductance component in a frequency band of 100 kHz or more is 25 or more.

14. An inductance component formed by applying a coil with at least one turn to a magnetic core which is the dust core according to claim 1, wherein a peak value of Q (1/tan δ) of the inductance component in a frequency band of 500 kHz or more is 40 or more.

15. An inductance component formed by applying a coil with at least one turn to a magnetic core which is the dust core according to claim 1, wherein a peak value of Q (1/tan δ) of the inductance component in a frequency band of 1 MHz or more is 50 or more.

16. A dust core comprising a molded mixture of a material powder comprising an amorphous soft magnetic alloy powder and a binder added thereto, wherein the amorphous soft magnetic alloy powder has a particle size of 200 μm or less (excluding zero), wherein a mixing ratio of the binder in the mixture is 3% or less by mass, a molding temperature is equal to or higher than a softening point of the binder, a space factor of the material powder in the magnetic core is 80% or more, a magnetic flux density is 0.6 T or more in applying a magnetic field of $1.6\times10^4$ A/m, and a resistivity is 0.1 Ω·cm or more, and wherein the amorphous soft magnetic allow powder is made of an amorphous soft magnetic alloy comprising a composition expressed by a formula of $(Fe_{1-\alpha}TM_\alpha)_{100-w-x-y-z}P_wB_xL_ySi_zTi_pC_qMn_rCu_s$, wherein unavoidable impurities are contained, wherein:

TM is at least one element selected from the group consisting of Co and Ni,

L is at least one element selected from the group consisting of Al, Cr, Zr, Mo, and Nb, $0\leq\alpha\leq0.3$, $2\leq w\leq11.5$ at %, $2\leq x\leq18$ at %, $15\leq w+\leq23$ at %, $1<y\leq5$ at %, $0\leq z\leq4$ at %, p, q, r, and s each represents an addition ratio given that the total mass of Fe, TM, P, B, L and Si is 100, and are defined as $0<p\leq0.3$, $0<q\leq0.5$, $0<r\leq2$, and $0<s\leq1$, the composition fulfills one of the following conditions (A) and (B):

(A) L is at least one element selected from the group consisting of Cr, Zr, Mo and Nb; and (B) L is a combination of Al and at least one element selected from the group consisting of Cr, Zr, Mo and Nb, wherein $0<Al\leq5$ at %, $1\leq Cr\leq4$ at %, $0<Zr\leq5$ at %, $2\leq Mo\leq5$ at %, and $2\leq Nb\leq5$ at %, the alloy has a crystallization start temperature (Tx) which is 550° C. or less, a glass transition temperature (Tg) which is 520° C. or less, and a supercooled liquid region represented by $\Delta Tx=Tx-Tg$, which is 20° C. or more, and the alloy has a Curie temperature which is 240° C. or more.

17. The dust core according to claim 16, wherein p, q, r, and s satisfy $0.1\leq p\leq0.3$, $0.1\leq q\leq0.5$, $0.1\leq r\leq2$, and $0.1\leq s\leq1$.

18. The dust core according to claim 16, wherein the alloy has a saturation magnetic flux density which is 1.2 T or more.

19. The dust core according to claim 16, wherein the amorphous soft magnetic alloy powder contains at least one of an amorphous soft magnetic alloy powder produced by water atomization and an amorphous soft magnetic alloy powder produced by gas atomization, and 50% or more in number of particles of the powder have a particle size greater than 3 μm.

20. The dust core according to claim 16, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 250 μm, and has a particle size with a center diameter of 192 μm or less.

21. The dust core according to claim 16, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 150 μm, and has a particle size with a center diameter of 96 μm or less.

22. The dust core according to claim 16, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 45 μm, and has a particle size with a center diameter of 30 μm or less.

23. The dust core according to claim 16, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 45 μm, and has a particle size with a center diameter of 20 μm or less.

24. The dust core according to claim 16, wherein the amorphous soft magnetic alloy powder has an aspect ratio of about 1 to 2.

25. The dust core according to claim 16, wherein the material powder contains a soft magnetic alloy powder in an amount of 5 to 50% by volume, the soft magnetic alloy powder having a smaller center particle size and a lower hardness than the amorphous soft magnetic alloy powder.

26. An inductance component formed by integrally molding the dust core according to claim 16 and a coil, wherein the coil is formed by winding a linear conductor by at least one turn and is disposed in the core.

27. An inductance component formed by applying a coil with at least one turn to a magnetic core which is the dust core according to claim 16, wherein a peak value of Q (1/tan δ) of the inductance component in a frequency band of 10 kHz or more is 20 or more.

28. An inductance component formed by applying a coil with at least one turn to a magnetic core which is the dust core according to claim 16, wherein a peak value of Q (1/tan δ) of the inductance component in a frequency band of 100 kHz or more is 25 or more.

29. An inductance component formed by applying a coil with at least one turn to a magnetic core which is the dust core according to claim 16, wherein a peak value of Q (1/tan δ) of the inductance component in a frequency band of 500 kHz or more is 40 or more.

30. An inductance component formed by applying a coil with at least one turn to a magnetic core which is the dust core according to claim 16, wherein a peak value of Q (1/tan δ) of the inductance component in a frequency band of 1 MHz or more is 50 or more.

31. A dust core comprising a molded mixture of a material powder comprising an amorphous soft magnetic alloy powder and a binder added thereto, wherein the amorphous soft magnetic alloy powder has a particle size of 200 μm or less (excluding zero), wherein a mixing ratio of the binder in the mixture is 1% or less by mass, a molding temperature is in a supercooled liquid region of the amorphous soft magnetic alloy powder, a space factor of the material powder in the magnetic core is 90% or more, a magnetic flux density is 0.9 T or more in applying a magnetic field of $1.6\times10^4$ A/m, and a resistivity is 0.01 Ω·cm or more, and wherein the amorphous soft magnetic allow powder is made of an amorphous soft magnetic alloy comprising a composition expressed by a formula of $(Fe_{1-\alpha}TM_{\alpha})_{100-w-x-y-z}P_wB_xL_ySi_zTi_pC_qMn_rCu_s$, wherein unavoidable impurities are contained, wherein:

TM is at least one element selected from the group consisting of Co and Ni,

L is at least one element selected from the group consisting of Al, Cr, Zr, Mo, and Nb, $0\leq\alpha\leq0.3$, $2\leq w\leq11.5$ at %, $2\leq x\leq18$ at %, $15\leq w+\leq23$ at %, $1<y\leq5$ at %, $0\leq z\leq4$ at %, p, q, r, and s each represents an addition ratio given that the total mass of Fe, TM, P, B, L and Si is 100, and are defined as $0<p\leq0.3$, $0<q\leq0.5$, $0<r\leq2$, and $0<s\leq1$, the composition fulfills one of the following conditions (A) and (B):

(A) L is at least one element selected from the group consisting of Cr, Zr, Mo and Nb; and (B) L is a combination of Al and at least one element selected from the group consisting of Cr, Zr, Mo and Nb, wherein $0<Al\leq5$ at %, $1\leq Cr\leq4$ at %, $0<Zr\leq5$ at %, $2\leq Mo\leq5$ at %, and $2\leq Nb\leq5$ at %, the alloy has a crystallization start temperature (Tx) which is 550° C. or less, a glass transition temperature (Tg) which is 520° C. or less, and a supercooled liquid region represented by $\Delta Tx=Tx-Tg$, which is 20° C. or more, and the alloy has a Curie temperature which is 240° C. or more.

32. The dust core according to claim 31, wherein p, q, r, and s satisfy $0.1\leq p\leq0.3$, $0.1\leq q\leq0.5$, $0.1\leq r\leq2$, and $0.1\leq s\leq1$.

33. The dust core according to claim 31, wherein the alloy has a saturation magnetic flux density which is 1.2 T or more.

34. The dust core according to claim 31, wherein the amorphous soft magnetic alloy powder contains at least one of an amorphous soft magnetic alloy powder produced by water atomization and an amorphous soft magnetic alloy powder produced by gas atomization, and 50% or more in number of particles of the powder have a particle size greater than 3 μm.

35. The dust core according to claim 31, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 250 μm, and has a particle size with a center diameter of 192 μm or less.

36. The dust core according to claim 31, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 150 μm, and has a particle size with a center diameter of 96 μm or less.

37. The dust core according to claim 31, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 45 μm, and has a particle size with a center diameter of 30 μm or less.

38. The dust core according to claim 31, wherein the amorphous soft magnetic alloy powder contains at least one of an amorphous soft magnetic alloy powder produced by water atomization and an amorphous soft magnetic alloy powder produced by gas atomization, is adapted to pass through a sieve having a mesh size of 45 μm, and has a particle size with a center diameter of 20 μm or less.

39. The dust core according to claim 31, wherein the amorphous soft magnetic alloy powder has an aspect ratio of about 1 to 2.

40. The dust core according to claim 31, wherein the material powder contains a soft magnetic alloy powder in an amount of 5 to 50% by volume, the soft magnetic alloy powder having a smaller center particle size and a lower hardness than the amorphous soft magnetic alloy powder.

41. An inductance component formed by integrally molding the dust core according to claim 31 and a coil, wherein the coil is formed by winding a linear conductor by at least one turn and is disposed in the core.

42. An inductance component formed by applying a coil with at least one turn to a magnetic core which is the dust core according to claim 31, wherein a peak value of Q (1/tan δ) of the inductance component in a frequency band of 10 kHz or more is 20 or more.

43. An inductance component formed by applying a coil with at least one turn to a magnetic core which is the dust core according to claim 31, wherein a peak value of Q (1/tan δ) of the inductance component in a frequency band of 100 kHz or more is 25 or more.

44. An inductance component formed by applying a coil with at least one turn to a magnetic core which is the dust core according to claim 31, wherein a peak value of Q (1/tan δ) of the inductance component in a frequency band of 500 kHz or more is 40 or more.

45. An inductance component formed by applying a coil with at least one turn to a magnetic core which is the dust core according to claim 31, wherein a peak value of Q (1/tan δ) of the inductance component in a frequency band of 1 MHz or more is 50 or more.

* * * * *